US005544059A

United States Patent [19]

Hikita et al.

[11] Patent Number: 5,544,059

[45] Date of Patent: Aug. 6, 1996

[54] TRAFFIC MEANS CONTROLLING APPARATUS

[75] Inventors: Shiro Hikita; Masafumi Iwata; Kiyotoshi Komaya; Masashi Asuka; Yukio Goto, all of Hyogo, Japan

[73] Assignee: Mitsubishi Denki Kabushiki Kaisha, Tokyo, Japan

[21] Appl. No.: 277,502

[22] Filed: Jul. 19, 1994

[30] Foreign Application Priority Data

| | | | |
|---|---|---|---|
| Jul. 27, 1993 | [JP] | Japan | 5-185142 |
| Mar. 25, 1994 | [JP] | Japan | 6-056052 |
| Jun. 23, 1994 | [JP] | Japan | 6-142005 |

[51] Int. Cl.[6] ..... B66B 1/00

[52] U.S. Cl. ..... 364/436

[58] Field of Search ..... 364/436; 187/391, 187/392, 393, 395

[56] References Cited

U.S. PATENT DOCUMENTS

| | | | |
|---|---|---|---|
| 5,022,497 | 6/1991 | Thanagavelu | 187/124 |
| 5,035,302 | 7/1991 | Thangavelu | 187/125 |
| 5,168,133 | 12/1992 | Bahjat et al. | 187/125 |
| 5,168,136 | 12/1992 | Thanagavelu et al. | 187/130 |
| 5,233,138 | 8/1993 | Amano | 187/127 |
| 5,241,142 | 8/1993 | Thangavelu | 187/125 |
| 5,250,766 | 10/1993 | Hikita et al. | 187/133 |
| 5,266,757 | 11/1993 | Krapek et al. | 187/116 |
| 5,272,288 | 12/1993 | Kameli | 187/127 |
| 5,276,295 | 1/1994 | Kameli | 187/132 |
| 5,283,399 | 2/1994 | Fujino et al. | 187/124 |
| 5,298,695 | 3/1994 | Bahjat et al. | 187/118 |
| 5,306,878 | 4/1994 | Kubo | 187/127 |
| 5,307,903 | 5/1994 | Morita et al. | 187/124 |
| 5,352,857 | 10/1994 | Ovaska | 187/247 |

FOREIGN PATENT DOCUMENTS

| | | |
|---|---|---|
| 0427992 | 5/1991 | European Pat. Off. . |
| 1-275381 | 11/1989 | Japan . |
| 4-28681 | 1/1992 | Japan . |
| 1280702 | 7/1972 | United Kingdom . |
| 2141843 | 1/1985 | United Kingdom . |
| 2235311 | 2/1991 | United Kingdom . |

OTHER PUBLICATIONS

Sandor Markon, et al "Adaptive Optimal Elevator Group Control by Neural Networks" 1991 Annual Conf. JP Neural Network Society.

*Primary Examiner*—Kevin J. Teska
*Assistant Examiner*—Stephen J. Walder, Jr.
*Attorney, Agent, or Firm*—Wolf, Greenfield & Sacks, P.C.

[57] ABSTRACT

The feature distinguishing part distinguishes feature modes from the traffic volume data detected by the traffic volume detecting part or from the traffic volume data estimated from the detected traffic volume data by the traffic volume estimating part, and the control parameter setting part sets the optimum control parameter according to the distinction results, further the drive controlling part controls the drive of cars on the control parameters. The distinction function constructing part constructs and modifies the distinction function of feature modes by learning prepared plural feature modes or the distinction results of past feature modes, furthermore the control result detecting part detects the control results or the drive results of cars, and corrects the control parameters. The control results or the drive results are exhibited on the user interface, and the control parameters are set and corrected from the outside by referring the results.

18 Claims, 19 Drawing Sheets

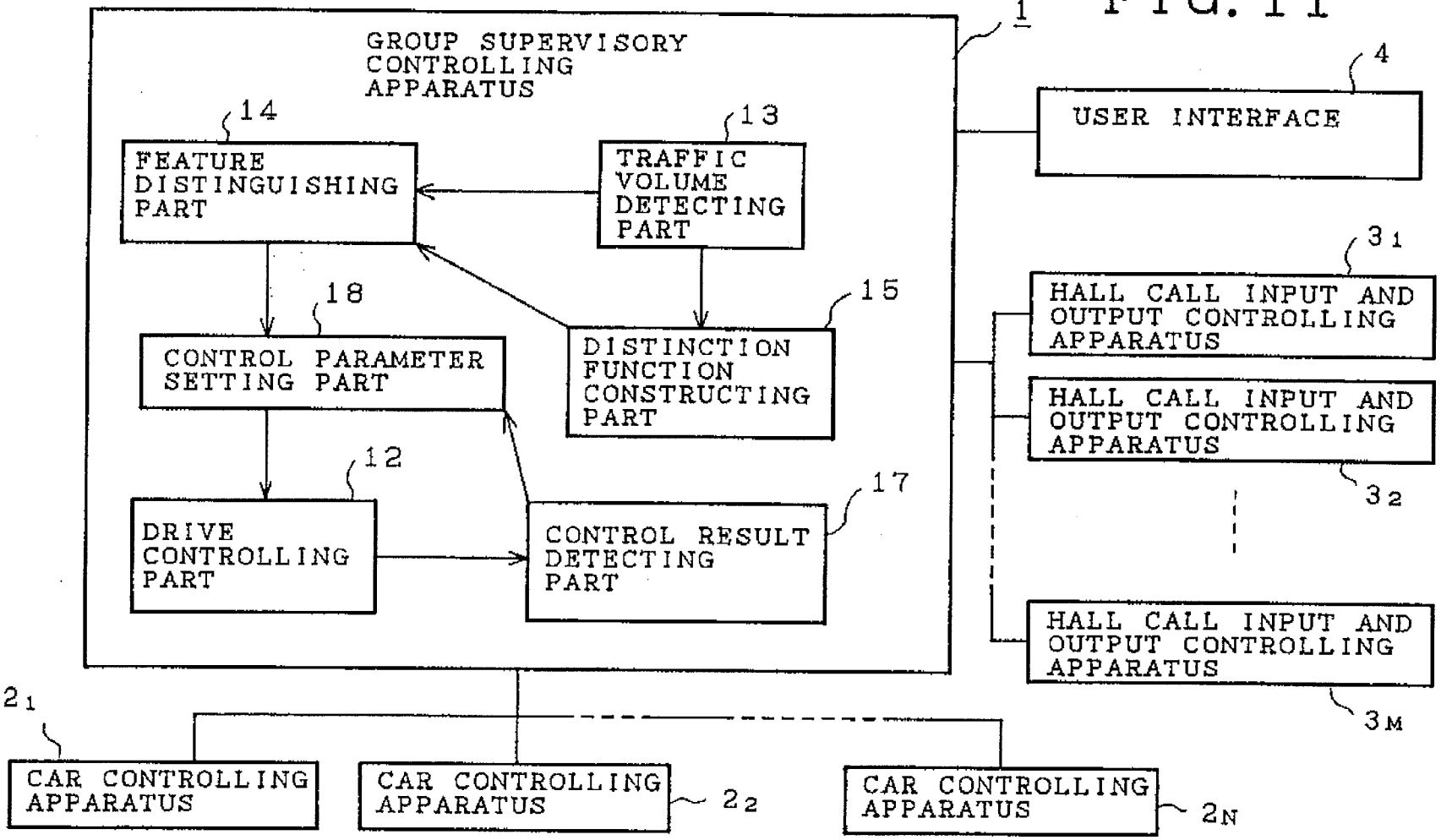
FIG. 11
1
GROUP SUPERVISORY CONTROLLING APPARATUS
4
USER INTERFACE
3 1
HALL CALL INPUT AND OUTPUT CONTROLLING APPARATUS
3 2
HALL CALL INPUT AND OUTPUT CONTROLLING APPARATUS
3 M
HALL CALL INPUT AND OUTPUT CONTROLLING APPARATUS
13
TRAFFIC VOLUME DETECTING PART
15
DISTINCTION FUNCTION CONSTRUCTING PART
17
CONTROL RESULT DETECTING PART
14
FEATURE DISTINGUISHING PART
18
CONTROL PARAMETER SETTING PART
12
DRIVE CONTROLLING PART
2 1
CAR CONTROLLING APPARATUS
2 2
CAR CONTROLLING APPARATUS
2 N
CAR CONTROLLING APPARATUS

TRAFFIC MEANS CONTROLLING APPARATUS

BACKGROUND OF THE INVENTION

1. Field of the Invention

This invention relates to a traffic means controlling apparatus for realizing the efficient control of traffic means such as elevators, traffic means in road traffic or railways, or the like.

2. Description of the Prior Art

FIG. 1 is a block diagram showing the construction of a conventional traffic means controlling apparatus applied to the group supervisory control of elevators. In FIG. 1, reference numeral 1 designates a group supervisory controlling apparatus executing the group supervisory control of plural elevators, reference numerals $\mathbf{2}_1$ to $\mathbf{2}_N$ designate car controlling apparatus respectively controlling each elevator car, axed reference numerals $\mathbf{3}_1$ to $\mathbf{3}_M$ designate hall call input and output controlling apparatus executing the inputting and outputting of hall calls of each floor. And, in the group supervisory controlling apparatus 1, reference numeral 11 designates a feature discriminating part discriminating feature modes classified into several patterns in a day, and reference numeral 12 designates a drive controlling means controlling the car controlling apparatus $\mathbf{2}_1$ to $\mathbf{2}_N$ in accordance with the feature modes discriminated by the feature discriminating part 11 and executing the group supervisory control of elevators.

Next, the operation will be described thereof. In a building equipped with plural elevators the control of each elevator is generally done by means of the group supervisory control. That is to say, the traffic service in such a building is promoted to be improved by means of practicing the group supervisory control, in which hall calls generated by each hall call input and output controlling apparatus $\mathbf{3}_1$ to $\mathbf{3}_M$ are watched online at first, and suitable elevators are selected under the consideration of the service states in the whole building, and then the selected elevators are assigned to the generated hall calls. Now, the traffic flows in a building greatly vary with the day of the week and the time zone in a day such as the opening time, the lunchtime, the closing time and the like. Accordingly, the group supervisory controlling apparatus 1 is required to control elevators with its control patterns switched according to the variations of the traffic flows at the time of the group supervisory control of elevators.

Therefore, in the conventional group supervisory control method, for example the numbers of persons getting on and off at each floor are observed, and the traffic volumes in the building at prescribed time zones are estimated (hereinafter these observable data are referred to as "traffic volume data" for distinguishing from the traffic flows), then the variations of the traffic flows are grasped from the traffic volume data. Namely, some variants to the traffic volume data (hereinafter referred to as "feature elements") such as the total numbers of persons getting on at specified time zones, the degrees of congestion at specific floors and the like are previously set, and the values of these feature elements are obtained from the traffic volume data, then the features of the traffic flows are described by the use of the combinations of the obtained values. And, a day is previously classified into some feature modes by means of extracting time zones having the values of the feature elements which are or may be regarded to be the same. The feature discriminating part 11 discriminates feature modes to determine which feature mode of the classified some feature modes corresponds, and sets control parameters for controlling each elevator to the drive controlling apparatus 12 in accordance with the discriminated feature modes. The drive controlling part 12 assigns the optimum elevators to the generated hall calls on the basis of the set control parameters to execute the group supervisory controlling of the car controlling apparatus $\mathbf{2}_1$ to $\mathbf{2}_N$.

For example, Japanese Unexamined Patent Publication No. Sho 59-22870 describes the techniques concerning such a conventional traffic means controlling apparatus.

The conventional traffic means controlling apparatus is constructed as described above, and consequently, it has the problems as follows. That is to say, the feature elements for describing the feature modes of traffic flows are needed to be previously set to be suitable to each building; if these feature elements are strictly set, the traffic of the building of a day becomes being classified into a great many numbers of feature modes; if the feature elements are simply set, the distinction precision of the feature modes becomes worse; furthermore, because each feature element are different in their units or importance respectively, it is frequently accompanied with difficulty to distinguish the identity among each feature mode suitably.

Furthermore, a user cannot refer to the control results or the drive results under the control parameters being the standard, and consequently, the conventional traffic means controlling apparatus has another problem that it is difficult to grasp the method of the efficient correction of the control parameters.

Furthermore, the conventional traffic means controlling apparatus can also estimate traffic volumes, but the conventional estimation of the traffic volumes is done by statistically treating past traffic volumes, for example by calculating the weighted averages of the traffic volumes at the same time zones for past several days. However, for example, there can be many differences in the beginning and ending times of rush hours or the numbers of passengers on days even in the same building, and consequently, the conventional traffic means controlling apparatus has another problem that errors happen in the estimated traffic volumes, then the distinction precision of the feature modes falls.

SUMMARY OF THE INVENTION

In view of the foregoing, it is an object of the present invention to provide a traffic means controlling apparatus which can efficiently control traffic means without using specified feature elements.

It is another object of the present invention to provide a traffic means controlling apparatus which can set and correct control parameters being efficient for users.

It is a further object of the present invention to provide a traffic means controlling apparatus which can distinguish traffic flows on the basis of the precisely estimated traffic volumes.

It is a further object of the present invention to provide a traffic means controlling apparatus which can distinguish feature modes with higher precision.

It is a further object of the present invention to provide a traffic means controlling apparatus which can easily detect the feature mode having the highest similarity from output values of plural neural networks (hereinafter referred to as "NN").

It is a further object of the present invention to provide a traffic means controlling apparatus which has the high ability to distinguish feature modes.

It is a further object of the present invention to provide a traffic means controlling apparatus which can always keep the distinction precision of the feature mode distinguishing means good.

It is a further object of the present invention to provide a traffic means controlling apparatus which can control traffic means by the use of the optimum control parameters.

It is a further object of the present invention to provide a traffic means controlling apparatus the control parameters of which can efficiently be set and corrected by a user.

According to the first aspect of the present invention, for achieving the above-mentioned objects, there is provided a traffic means controlling apparatus comprising a feature distinguishing part distinguishing the feature modes of the traffic flows in prescribed time zones from the traffic volume data in traffic means detected by a traffic volume detecting part, a control parameter setting part setting control parameters in accordance with the distinguished results by the feature distinguishing part, and a distinction function constructing part constructing and modifying the distinction function of the feature distinguishing part.

As stated above, in the traffic means controlling apparatus according to the first aspect of the present invention, its distinction function is constructed and modified by the distinction function constructing part, and its feature distinguishing part distinguishes the feature modes of the traffic flows in the prescribed time zones from the traffic volume data of traffic means detected by the traffic volume detecting part to send the distinguished results to the control parameter setting part and makes the control parameter setting part set the optimum control parameters based on the distinguished results, and consequently, the traffic means controlling apparatus which can effectively control traffic means without using specified feature elements is realized.

According to the second aspect of the present invention, there is provided a traffic means controlling apparatus equipped with a control result detecting part detecting the control results and the drive results of traffic means; the traffic means controlling apparatus makes its control parameter setting part have the function of correcting control parameters in accordance with the control results and the drive results detected by the control result detecting part; further the traffic means controlling apparatus is equipped with a user interface for user's setting and correcting the control parameters from the outside while the control results and the drive results are referred.

As stated above, in the traffic means controlling apparatus according to the second aspect of the present invention, its control parameter setting part sets the optimum control parameters on the basis of the feature modes distinguished by the feature distinguishing part and corrects the control parameters in accordance with the control results and the drive results detected by the control result detecting part, on the other hand its user interface exhibits the control results and the drive results to a user as reference data and have the user set and correct the control parameters, and consequently, the traffic means controlling apparatus which can efficiently control traffic means can be realized.

According to the third aspect of the present invention, there is provided a traffic means controlling apparatus equipped with a traffic volume estimating part estimating the traffic volumes in the near future by executing the sampling processing of the traffic volumes detected by a traffic volume detecting part in real time; the traffic means controlling apparatus distinguishes the feature modes of traffic volumes from the traffic volumes estimated by the traffic volume estimating part.

As stated above, in the traffic means controlling apparatus according to the third aspect of the present invention, its traffic volume estimating part estimates the traffic volumes in the near future by executing the sampling processing of the traffic volumes detected by the traffic volume detecting part in real time, and the traffic means controlling apparatus distinguishes the feature modes of traffic volumes from the estimated traffic volumes. Consequently, the traffic means controlling apparatus which can distinguish the feature modes of traffic flows on the basis of the precisely estimated traffic volumes is realized.

According to the fourth aspect of the present invention, there is provided a traffic means controlling apparatus equipped with a feature mode distinguishing means in its feature distinguishing part; the feature mode distinguishing means executes the distinction of feature modes from the detected traffic volume data by the use of a NN.

As stated above, in the traffic means controlling apparatus according to the fourth aspect of the present invention, its feature mode distinguishing means executes the distinction of feature modes from traffic volume data by the use of the NN, and consequently, the traffic means controlling apparatus which can distinguish feature modes with higher precision is realized.

According to the fifth aspect of the present invention, there is provided a traffic means controlling apparatus equipped with a feature mode detecting means in its feature distinguishing part; the feature mode detecting means comprises a filter filtering the output values of a NN, and a feature mode specifying means specifying feature modes from the outputs of the filter.

As stated above, in the traffic means controlling apparatus according to the fifth aspect of the present invention, its feature mode detecting means filters the output values of the NN by the filter and after that specifies feature modes by the feature mode specifying means, and consequently, the traffic means controlling apparatus which can detect the feature mode having the highest similarity is realized.

According to the sixth aspect of the present invention, there is provided a traffic means controlling apparatus equipped with an additional filtering means correcting the filter function of the filter in its feature mode detecting means.

As stated above, in the traffic means controlling apparatus according to the sixth aspect of the present invention, its additional filtering means corrects the filter function to enable the specification of the feature modes in case of being incapable of specifying the feature mode having the highest similarity, and consequently, the traffic means controlling apparatus having the high ability to distinguish the feature modes is realized.

According to the seventh aspect of the present invention, there is provided a traffic means controlling apparatus equipped with an additional feature mode specifying means correcting the feature mode specification function of the feature mode specifying means in its feature mode detecting means.

As stated above, in the traffic means controlling apparatus according to the seventh aspect of the present invention, its additional feature mode specifying means corrects the feature mode specification function to enable the specification of feature modes in case of being incapable of specifying feature modes from the output values of its filter, and consequently, the traffic means controlling apparatus having the high ability of distinguishing the feature modes is realized.

According to the eighth aspect of the present invention, there is provided a traffic means controlling apparatus equipped with a NN for control usually executing the distinction of feature modes and a NN for backup periodically executing the distinction of feature modes in the feature mode distinguishing means of its feature distinguishing part; further the traffic means controlling apparatus is equipped with a distinction function constructing means having the function of comparing and evaluating each of the distinction results in case of using the two kinds of NNs and the function of executing the correction of the NN for control by replacing the contents of the NN for control with the contents of the NN for backup or by duplicating the latter to the former when the distinction results in case of using the NN for backup are superior to the distinction results in case of using the NN for control.

As stated above, in the traffic means controlling apparatus according to the eighth aspect of the present invention, its distinction function constructing means replaces the contents of the NN for control with the contents of the NN for backup or duplicates the latter to the former when the distinction results in case of using the NN for backup are superior to the distinction results in case of using the NN for control, and consequently, the traffic means controlling apparatus which can always keep the distinction precision of the feature mode distinguishing means good is realized.

According to the ninth aspect of the present invention, there is provided a traffic means controlling apparatus making its distinction function constructing part have the function of constructing the distinction function of its NN by means of learning the previously prepared plural feature modes and the function of modifying the distinction function by means of learning the distinction results of past feature modes.

As stated above, in the traffic means controlling apparatus according to the ninth aspect of the present invention, its distinction function constructing part constructs and modifies the distinction function of the NN by learning the previously prepared plural feature modes and the distinction results of past feature modes, and consequently, the traffic means controlling apparatus which can always keep the distinction precision of its feature mode distinguishing means good is realized.

According to the tenth aspect of the present invention, there is provided a traffic means controlling apparatus making its control parameter setting part have the function of executing the setting of the standard values of control parameters in accordance with the distinction results of its feature distinguishing part and the function of executing the correction of the standard values of the control parameters by means of offline tuning in accordance with control results and drive results.

As stated above, in the traffic means controlling apparatus according to the tenth aspect of the present invention, its control parameter setting part sets the standard values of control parameters in accordance with feature mode distinction results and corrects the standard values of the control parameters in accordance with the control results and the drive results by means of offline tuning, and consequently, the traffic means controlling apparatus which can control traffic means by the use of the optimum control parameters is realized.

According to the eleventh aspect of the present invention, there is provided a traffic means controlling apparatus making its control parameter setting part have the function of executing the setting of the standard values of control parameters in accordance with the distinction results of its feature distinguishing part and the function of correcting the control parameter values from the standard values by means of online tuning in accordance with the control results and the drive results detected in real time.

As stated above, in the traffic means controlling apparatus according to the eleventh aspect of the present invention, its control parameter setting part sets the standard values of control parameters in accordance with feature mode distinction results and corrects the control parameter values from the standard values by means of online tuning in accordance with the control results and the drive results detected in real time, and consequently, the traffic means controlling apparatus which can control traffic means by the use of the optimum control parameters is realized.

According to the twelfth aspect of the present invention, there is provided a traffic means controlling apparatus making its user interface have the function of exhibiting control results, drive results and the like to a user as reference data, and the function of receiving directions for setting and correcting control parameters from the user.

As stated above, in the traffic means controlling apparatus according to the twelfth aspect of the present invention, its user interface exhibits control results, drive results and the like to a user as reference data, and consequently, the traffic means controlling apparatus where the user can effectively set and correct the control parameters from the outside is realized.

The above and further objects and novel features of the present invention will more fully appear from the following detailed description when the same is read in connection with the accompanying drawings. It is to be expressly understood, however, that the drawings are for purpose of illustration only and are not intended as a definition of the limits of the invention.

BRIEF DESCRIPTION OF THE DRAWINGS

FIG. 11 is a block diagram showing the construction of the embodiment 2 of the traffic means controlling apparatus of the present invention applied to the group supervisory control of elevators;

DETAILED DESCRIPTION OF THE PREFERRED EMBODIMENTS

Preferred embodiments of the present invention will now be described in detail with reference made to the accompanying drawings.

EMBODIMENT 1

Figure 2:
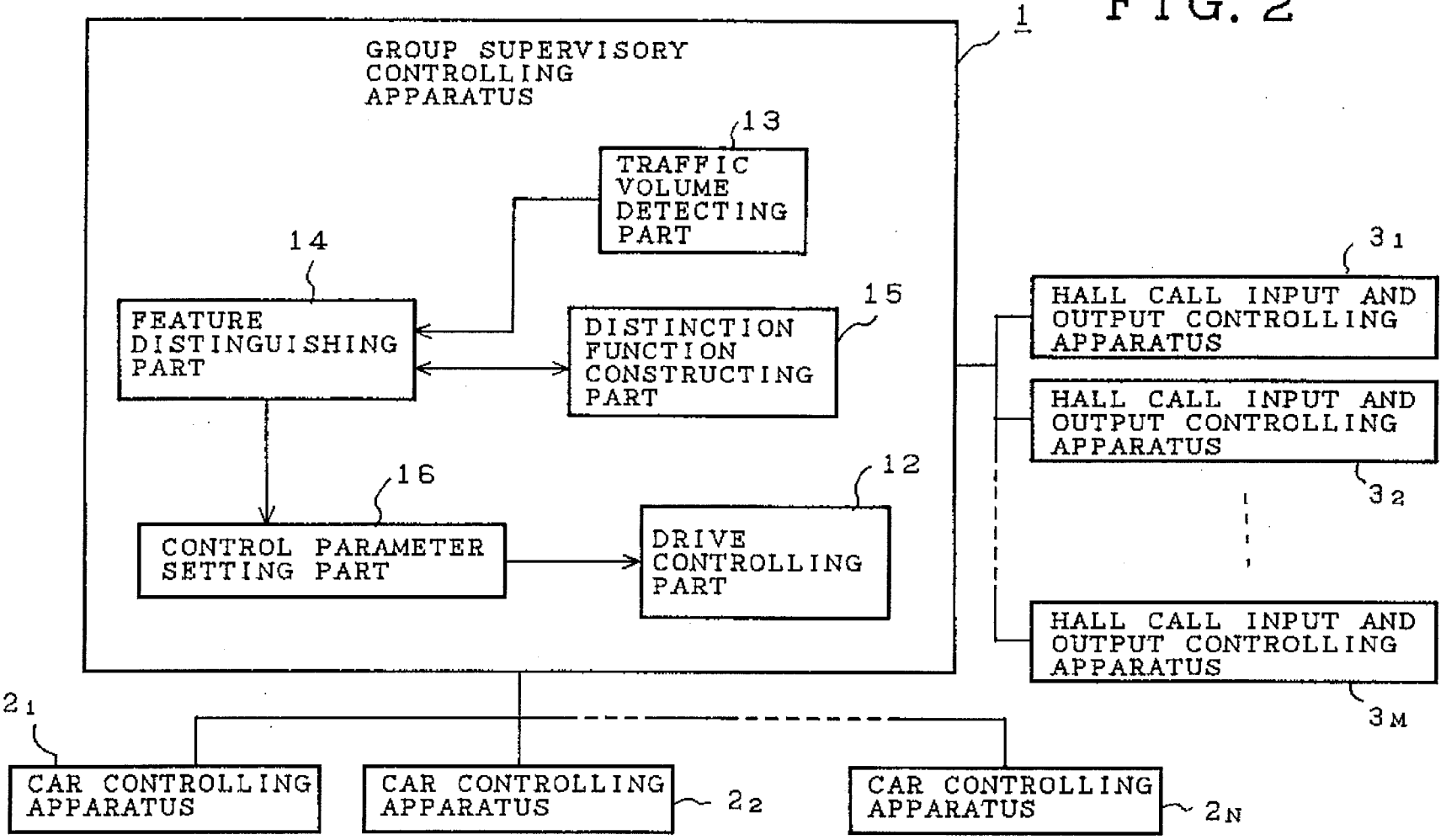
FIG. 2 is a block diagram showing the construction of the embodiment 1 of the traffic means controlling apparatus of the present invention applied to the group supervisory control of elevators.

Hereinafter, the embodiment 1 of the present invention will be described with drawings referred. FIG. 2 is a block diagram showing the construction of an embodiment of the traffic means controlling apparatus of the present invention, which is applied to the group supervisory control of elevators.

Figure 1:
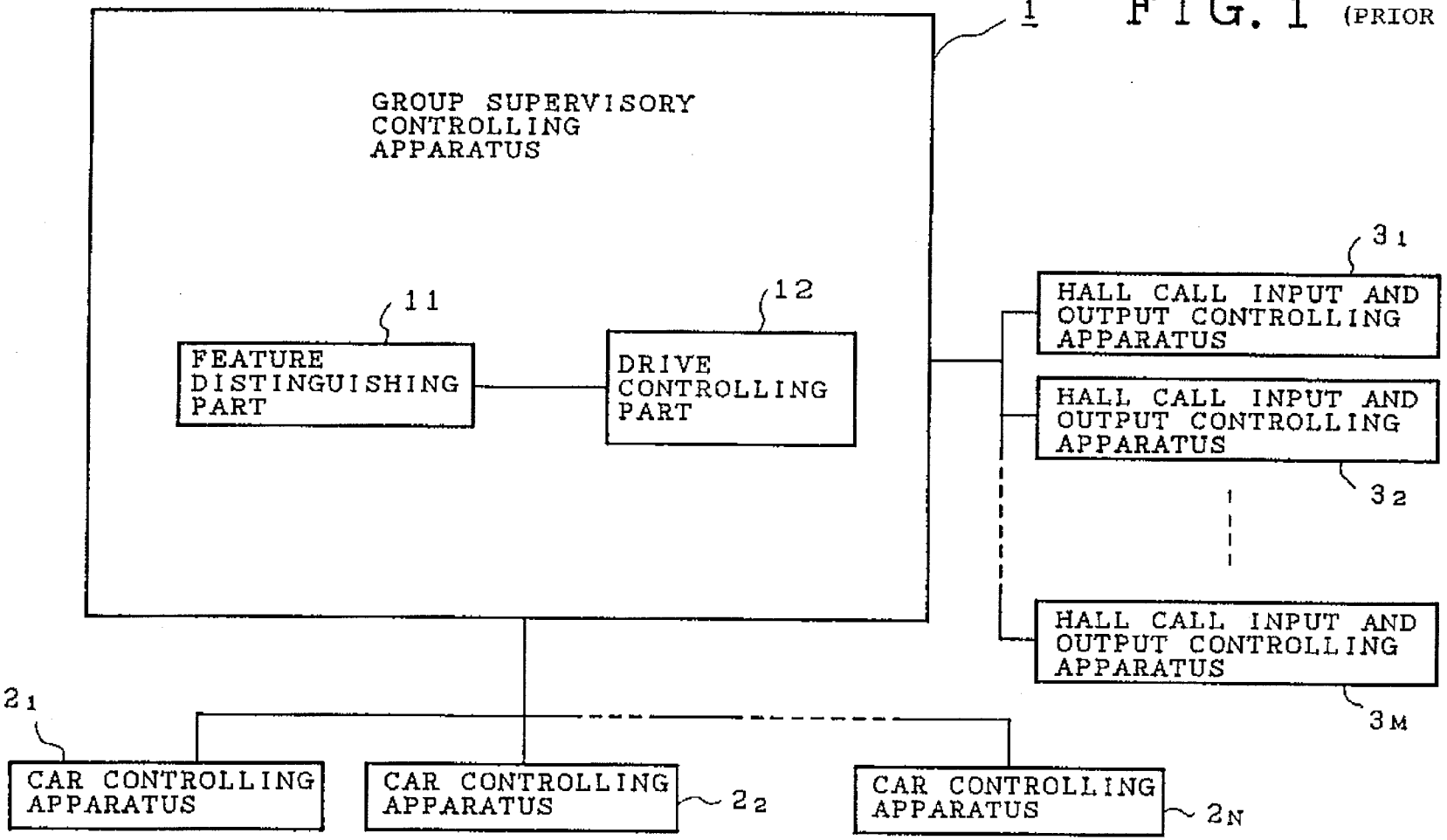
FIG. 1 (PRIOR ART)
FIG. 1 is a block diagram showing the construction of a conventional traffic means controlling apparatus applied to the group supervisory control of elevators.

In FIG. 2, reference numeral 1 designates a group supervisory controlling apparatus, reference numerals $\mathbf{2}_1$ to $\mathbf{2}_N$ designate car controlling apparatus, reference numerals $\mathbf{3}_1$ to $\mathbf{3}_M$ designate hall call input and output controlling apparatus, and reference numeral 12 designates a drive controlling part. These construction elements are the same as or equivalent to the elements of the conventional traffic means controlling apparatus which are denoted by the same reference numerals in FIG. 1, then the detailed description of them will be omitted.

Reference numeral 13 designates a traffic volume detecting part monitoring hall calls, the numbers of passengers getting on or off, or the like, and executing the statistical treatment of them for detecting the estimated traffic volumes at prescribed time zones on the day when the control is done; and reference numeral 14 designates a feature distinguishing part distinguishing the feature modes of the traffic flows at the prescribed time zones from the traffic volume data detected by the traffic volume detecting part 13. Reference numeral 15 designates a distinction function constructing means constructing and modifying the distinction function of the feature distinguishing part 14 by learning, and reference numeral 16 designates a control parameter setting part setting control parameters to the drive controlling part 12 for the optimum group supervisory control of elevators. Then, the group supervisory controlling apparatus 1 is composed of these traffic volume detecting part 13, feature distinguishing part 14, distinction function constructing part 15, control parameter setting part 16 and drive controlling part 12.

Figure 3:
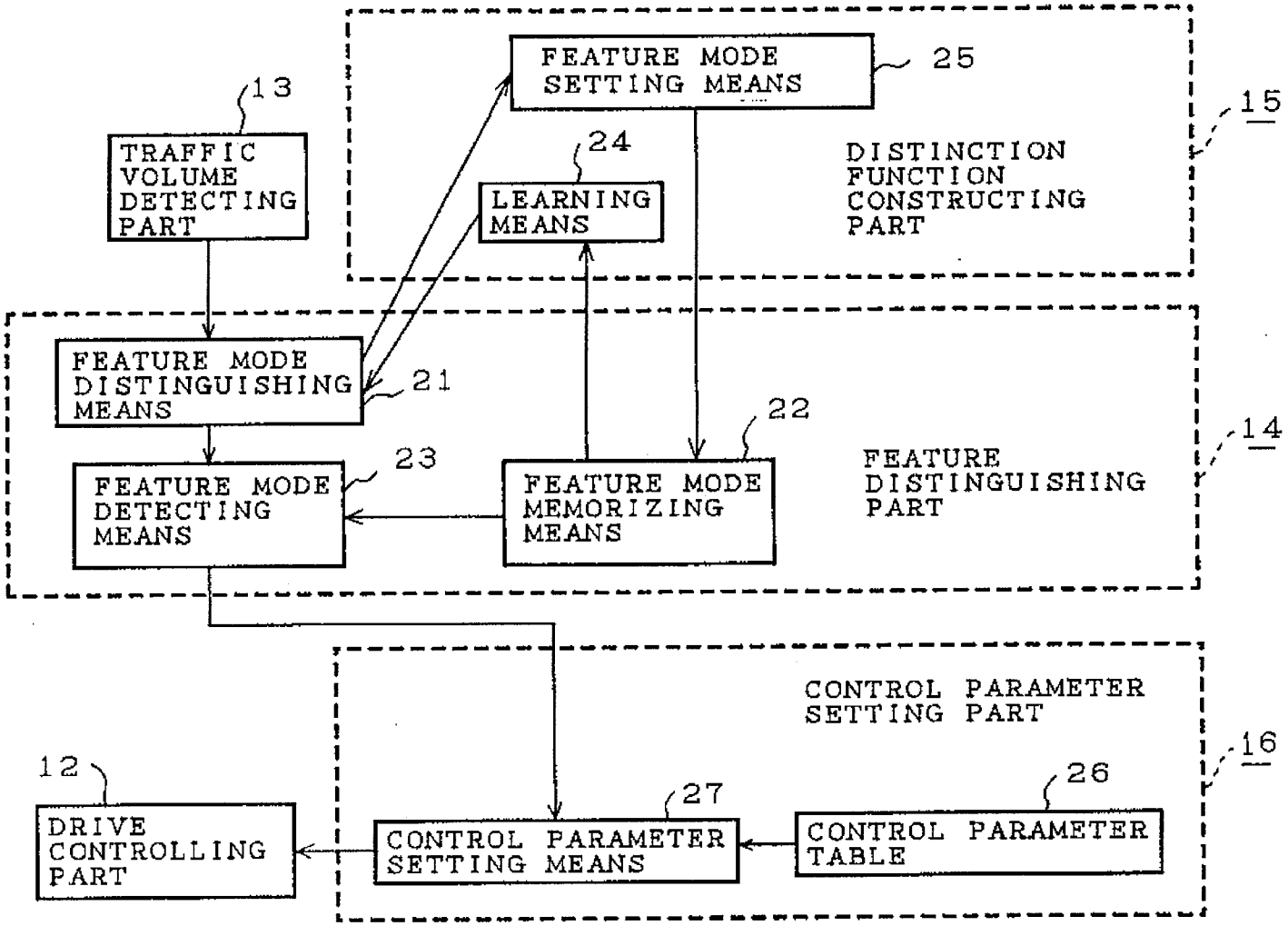
FIG. 3 is a block diagram showing the construction of the group supervisory controlling apparatus of the embodiment 1.

Furthermore, FIG. 3 is a block diagram showing the detailed construction of the group supervisory controlling apparatus 1. In FIG. 3, reference numeral 21 designates a feature mode distinguishing part distinguishing feature modes from the traffic volume data detected by the traffic volume detecting part 13, reference numeral 22 designates a feature mode memorizing means registering the traffic volume data at plural time zones and the feature modes corresponding to each of the traffic volume data, reference numeral 23 designates a feature mode detecting means selecting the feature mode having the highest similarity from the outputs of the feature mode distinguishing means 21 on the basis of the contents of the feature mode memorizing means 22, and the feature distinguishing part 14 is composed of each of these means.

Reference numeral 24 designates a learning means executing the learning for setting and modifying the distinction function in the feature distinguishing part 14, reference numeral 25 designates a feature mode setting means setting the feature modes based on the results of the learning to the feature mode memorizing means 22, and the distinction function constructing part 15 is composed of each of these means.

Reference numeral 26 designates a control parameter table storing the control parameters for the group supervisory control of elevators, reference numeral 27 designates a control parameter setting means selecting the control parameters stored in the control parameter table 26 on the basis of the feature modes from the feature mode detecting means 23 and setting them to the drive controlling part 12, and the control parameter setting part 16 is composed of each of these means.

Figure 4:
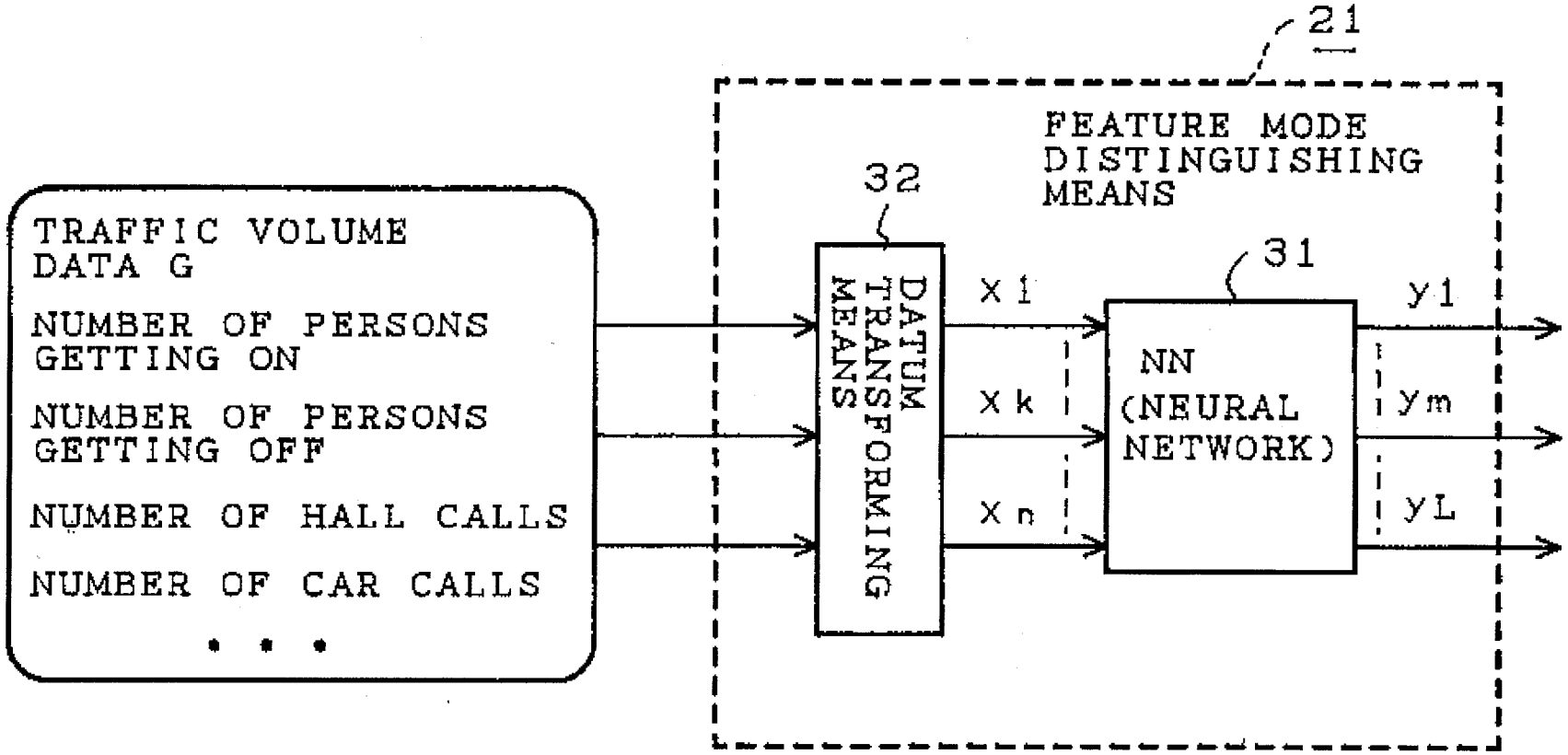
FIG. 4 is a block diagram showing the construction of the feature mode distinguishing means of the embodiment 1.
Figure 5:
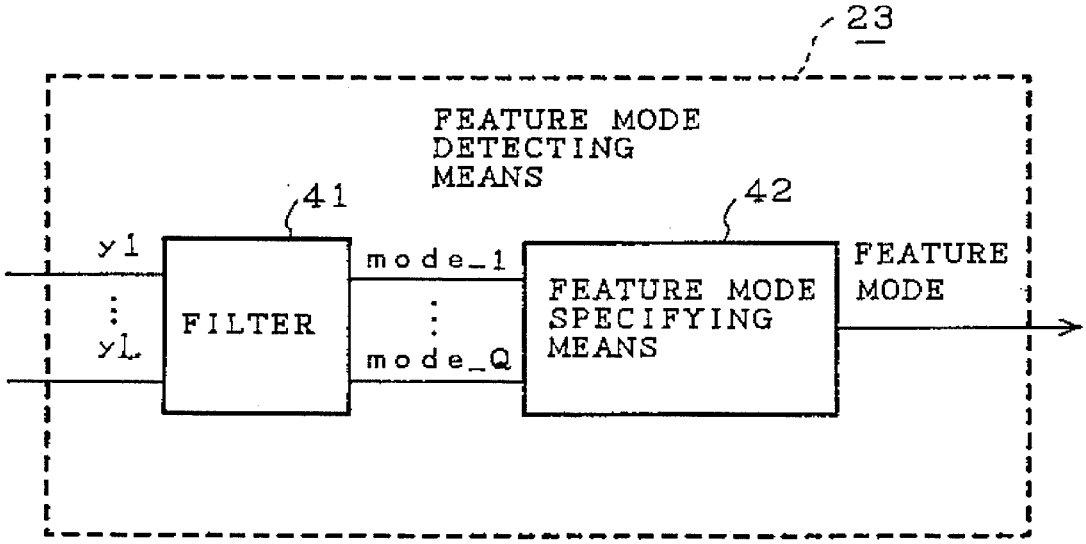
FIG. 5 is a block diagram showing the construction of the feature mode detecting means of the embodiment 1.

Now, FIG. 4 is a block diagram showing the inside construction of the aforementioned feature mode distinguishing means 21, and FIG. 5 is a block diagram showing the inside construction of the aforementioned feature mode detecting means 23. In FIG. 4, reference numeral 31 designates a NN processing the traffic volume data G from the traffic volume detecting part 13 to execute the distinction of feature modes actually, reference numeral 32 designates a datum transforming means transforming each element of the traffic volume data G into the formats capable of being handled by the NN 31, and the feature mode distinguishing means 21 is composed of these elements.

In FIG. 5, reference numeral 41 designates a filter filtering each output of neurons of the NN 31 in the feature mode distinguishing means 21, reference numeral 42 designates a feature mode specifying means specifying one feature mode out of the outputs of the filter 41, and the feature mode detecting means 23 is composed of these elements.

Next, the operation will be described thereof. At first, the basic concept of the feature mode distinction of traffic flows will be described before the detailed description of the operation.

Now, the traffic volume data G being observable in the group supervisory control of elevators are, for example, as follows:

traffic volume data: G=(p, q, h, c)

p: the number of persons getting on at each floor q: the number of person,s getting off at each floor h: the number of hall calls at each floor c: the number of car calls at each floor Furthermore, a day is divided into a prescribed time units (for example 5 minutes), and several time zones, in which featured traffic flows are generated in the building where the elevators are installed, are set; then the feature modes are supposed to be each of the set time zones. Besides, the traffic volume data G are observed for a prescribed period of time (for example, a week), and the traffic volumes to the feature modes set as the following equations.

feature mode 1: $G_1=(p_1, q_1, h_1, c_1)$ feature mode 2: $G_2=(p_2, q_2, h_2, c_2)$ feature mode 3: $G_3=(p_3, q_3, h_3, c_3)$ . . .

feature mode i: $G_i=(P_i, q_i, h_i, c_i)$ . . .

Figure 6:
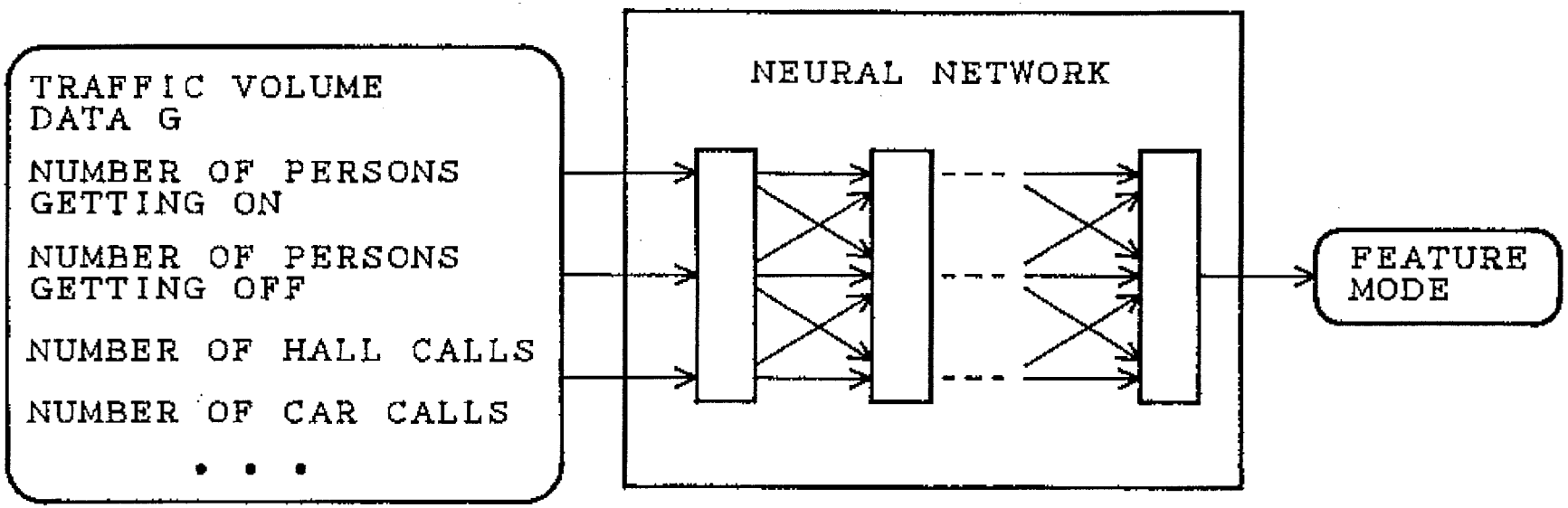
FIG. 6 is a conceptional drawing showing the NN used in the feature mode distinguishing means of the embodiment 1.

Then, a multilayer type NN, for example shown in FIG. 6, is prepared, and the NN is previously made to learn the relationships between these feature modes and the traffic volume data. Consequently, when the traffic volume data at a certain time zone are inputted into the NN, the NN becomes outputting the most similar feature mode to the inputted traffic volume data among the prepared feature modes, for example the feature mode 1 is most similar to the inputted traffic volume data, in conformity with the general characteristics of NNs. Thereby, if feature modes are set previously, for example as follows: an early morning type feature mode (feature mode 1) at the time zone 7:00–7:05, an opening time type feature mode (feature mode 2) at the time zones 8:15–9:20, and an ordinary time type feature mode (feature mode 3) at the time zone 10:00–10:05; then, the beginning time and the ending time of control patterns can be obtained from the aforementioned distinguished results of the NN 31 concerning the time zones between the set feature modes, for example the control of elevators may be done by selecting feature mode 2 to the time zones 8:00–8:40, and feature modes 1 and 3 respective to the time zones before and after the time zones 8:00–8:40.

Furthermore, there are some cases where the NN 31 cannot distinguish suitable feature modes in the case where peculiar traffic volume data are inputted or the number of prepared feature modes is insufficient. In this case, it may be appropriate to additionally set the time zone at which the distinction could not be done as a new feature mode, and to adjust the NN 31 by means of learning again. By repeating these procedures, the number of feature modes necessary and enough to control can be extracted, and the precise distinction of feature modes can be executed without using previously set feature elements which is necessary in prior arts.

The control parameters in the group supervisory control of elevators are many kinds of data such as the numbers of allocated cars to the congested floors and the division of service floors at the opening time, the setting of floors to which elevators are forwarded at the closing time, and the like. However, if the feature mode of a traffic flow can be specified, the control result under specified control parameters can be evaluated from the traffic volume corresponding to the specified feature mode by methods such as simulations and the like. Then, by evaluating control results to each value of control parameters, it is enabled to set the optimum control parameters to each feature mode. Consequently, if the distinction of traffic flow feature modes is capable, the optimum control parameters can automatically be set. Such concept is realized by means of the embodiment 1 shown in FIG. 2 to FIG. 5.

Figure 7:
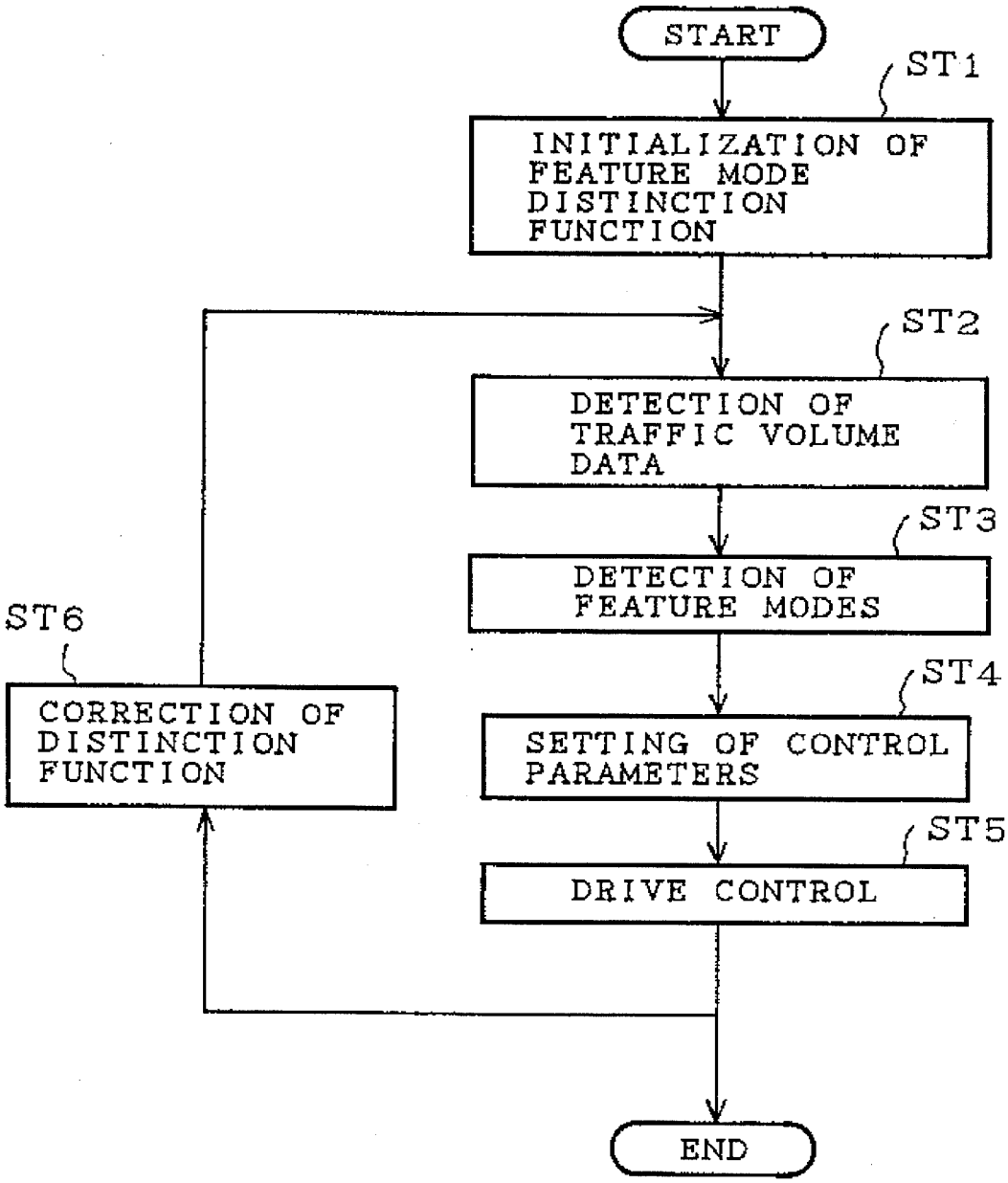
FIG. 7 is a flowchart showing the outline of the group supervisory control procedures of elevators in the embodiment 1.

Hereinafter, the detailed description concerning the group supervisory control of elevators by means of the traffic means controlling apparatus of the embodiment 1 shown in FIG. 2 to FIG. 5 will be described in accordance with the flowcharts shown in FIG. 7 to FIG. 10. Now, FIG. 7 is a flowchart showing the outline of this group supervisory control of elevators. At first, before beginning the control, the initialization of the distinction function of the feature distinguishing part 14 is executed at STEP ST1. As described before, the distinction of the feature modes of traffic flows in the embodiment 1 is practiced by using the NN 31. The initialization of the presuming function here means that the NN 31 of the feature mode distinguishing means 21 in the feature distinguishing part 14 is previously set to be suitable accordingly.

Figure 8:
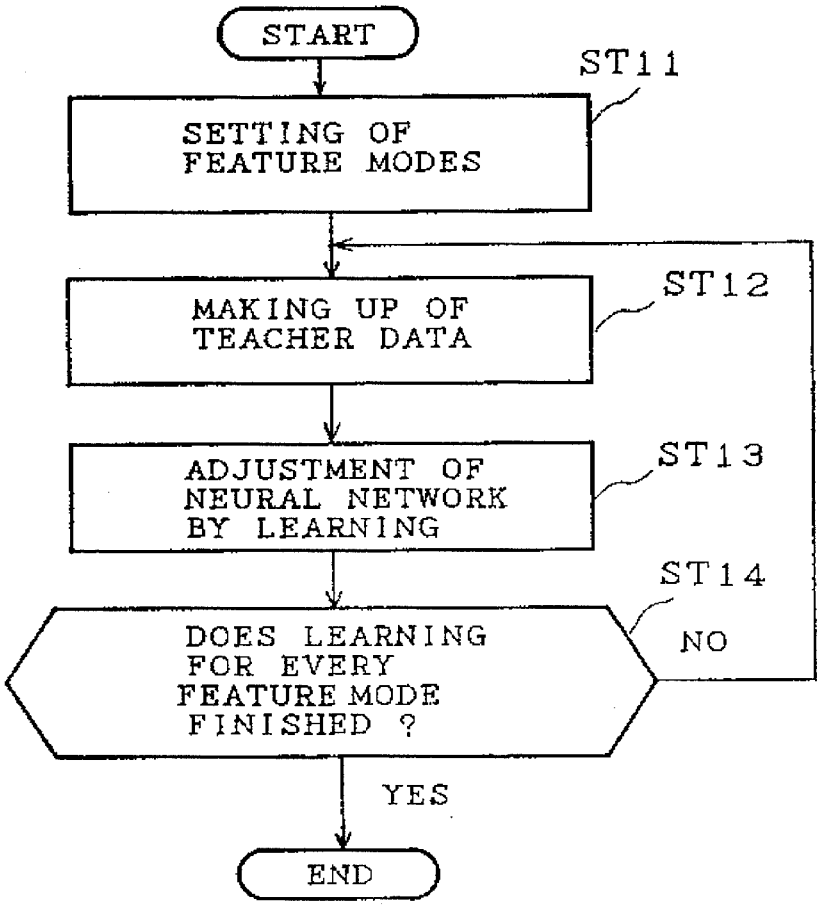
FIG. 8 is a flowchart showing the initialization procedures of the feature mode distinction function in the group supervisory control procedures of elevators.

FIG. 8 is a flowchart showing this initialization procedures in detail.

After the initialization processes of the distinction function of feature modes is begun, the following processings concerning the setting of feature modes are executed at STEP ST11 at first. That is to say, plural time zones in which featured traffic flows is supposed to be generated in the building where the elevators are installed are previously appointed first, and each of them is set to be the traffic flow feature modes. Then, each feature mode and the traffic volume data at the time zones are previously registered in the feature mode memorizing means 22 of the feature distinguishing part 14. On that occasion, the setting of time zones may be done such as, for example, feature mode 1 at the time zone 8:00–8:05, or may be done using plural time zones such as feature mode 1 at the time zones 8:00–8:05, 8:05–8:10, and 8:10–8:15. Moreover, the optimum control parameters are previously set to the set traffic flow feature modes by means of a simulation method and the like, and they are registered into the control parameter table 26 in the control parameter setting part 16 in advance. The number of the feature modes and the set time zones are capable of being automatically altered by the method to be described later. This STEP ST11 is a procedure necessary only in the initialization definitely.

On that occasion, indices 1, . . . , L (L: the number of the feature modes) are attached to the feature modes registered in the feature mode memorizing means 22 in advance. Besides, the number of the neurons of the input layer of the NN 31 is set to the number of the elements of the traffic volume data G, and the number of the neurons of the output layer of the NN 31 is set to the number of the feature modes (aforementioned "L") previously. The number of the intermediate layers and the number of the neurons of each intermediate layer may arbitrarily be set in accordance with the specification of the building or the number of the installed elevators.

Next, the setting of the NN 31 by the learning means 24 will be done. For this sake, teacher data are made up from each traffic flow feature mode registered in the feature mode memorizing means 22 at STEP ST12 at first. To put it concretely, the input side teacher data are composed of the values "X" ($X=(x_1, \ldots, x_n)$, $0 \leqq x_1, \ldots, x_n \leqq 1$, n: the number of elements of traffic volume data G) which are each element value of the traffic volume data corresponding to each feature mode transformed into the form capable of being inputted into the NN 31 by the datum transforming means 32 in the feature mode distinguishing means 21. Also, if the traffic volume data corresponds to the mth feature mode (hereinafter referred to as $T_m$), the output side teacher data are composed of the outputs "Y" ($Y=(y_1, \ldots, y_L)$, $0 \leqq y_1, \ldots, y_L \leqq 1$) of each neuron in the output layer of the NN 31 in which the value of the output corresponding to the mth feature mode $T_m$ is set to be 1 and the value of the outputs of the other neurons are set to be 0. That is to say, the output side teacher data are designated as the following equations:

$$y_i=1 \text{ (when } i=m)$$

$$y_i=0 \text{ (when } i \neq m)$$

Successively, the learning is done by means of, for example, well known Back Propagation Method using the teacher data thus made, and the NN 31 in the feature mode distinguishing means 21 is adjusted at STEP ST13.

The aforementioned procedures of STEPs ST12 and ST13 are repeated until the learning of all the feature modes registered in the feature mode memorizing means 22 is determined to be finished at STEP ST14.

By setting the NN 31 appropriate by making them learn in the procedures mentioned above in advance, when the traffic volume data in arbitrarily time zones are inputted, the NN 31 becomes outputting a large value (near to 1) from the neuron of the output layer corresponding to the greatly similar feature mode to the traffic volume data and outputting small values (near to 0) from the neurons of the output layer corresponding to the not so much similar feature modes to the traffic volume data in conformity of the general characteristics of NNs. That is to say, if the inputted traffic volume data are similar to the feature mode $T_m$, the NN 31 in the feature mode distinguishing means 21 outputs the value $y_m$ closely similar to 1 ($y_m \approx 1$) only from the neuron in the output layer corresponding to the feature mode $T_m$, and outputs values $y_i$ closely similar to 0 from the other neurons in the output layers ($y_i \approx 0$, $i \neq m$). Consequently, the NN 31 can be considered to output the similarity between the traffic volume data in the inputted time zones and the traffic volume data of each feature mode.

In daily control after such initialization of the distinction function was finished, at first in STEP ST2, the traffic volume detecting part 13 detects the estimated traffic volume data G in the prescribed time zones on the day when the control is done, and transmits the detected traffic volume data G to the feature distinguishing part 14. The feature distinguishing part 14, which has received the traffic volume data, distinguishes which feature mode the traffic volume data belongs to, namely which traffic volume data of feature modes the traffic volume data is most similar to, in STEP ST3.

Hereinafter, the detail of the feature mode distinction function will be described with the flowchart of FIG. 9 referred.

At first, the traffic volume data detected by the traffic volume detecting means 13 are inputted to the feature mode distinguishing means 21 at STEP ST21. After the feature mode distinguishing means 21 inputs the traffic volume data to the datum transforming means 32 to transform, successively, the feature mode distinguishing means 21 inputs the transformed data to the NN 31. Then, the NN 31 operates the well-known network operations at STEP ST22, and transmits the output values $y_1, \ldots, y_L$ to the feature mode detecting means 23.

The feature mode detecting means 23, which received the output values $y_1, \ldots, y_L$, selects the feature mode having the most high similarity out of them at STEP ST23. For the selection, it is desirable to use a filter 41 as shown in FIG. 5. This is because the outputs of the NN 31 are usually real values and it is difficult to select feature modes from the real values directly. The inputs of the filter 41 are the inputs to the feature mode detecting means 23, namely the outputs of the NN 31, and the outputs mode_1 , . . . , mode_Q of the filter 41 ("Q" is the number of the outputs of the filter 41) correspond to each feature mode, "being impossible of specifying feature modes", and "being impossible of distinguishing feature modes". And, only one of the output values of the filter 41 corresponding to any suitable one of the feature modes, "being impossible of specifying feature modes", and "being impossible of distinguishing feature modes" becomes the value of 1 and the other output values become the value of 0. Upon this, "being impossible of specifying feature modes" indicates the case where two or more feature modes, being considered to be highly similar to each other, exist and specifying any of them is impossible. Further, "being impossible of distinguishing feature modes" indicates the case where the any output of NN 31 does not correspond to any prepared feature mode, because the outputs are small.

The relationship of the outputs of the NN 31 and the outputs of the filter 41 is generally expressed as follows:

$$\text{mode_}i=\text{filter_}i\ (y_1, \ldots, y_L)\ (1 \leqq i \leqq Q,\ Q \geqq L)$$

$$\text{mode_}i \in \{0, 1\}$$

where sign "filter_i" designates a function expressing the characteristic of the filter 41 processing the inputs from the NN 31 and outputting "mode_i". As for the filtering characteristics of the filter 41, some kinds of them can considered, but only four kinds of them will be described hereinafter. Provided that the filtering characteristics of the filter 41 are not limited to the four.

The first filtering characteristic among them is a maximum value filter making only one output of the filter 41 the value of 1, which output of the filter 41 corresponds to the output of the NN 31 having the maximum value among the output values $y_1, \ldots, y_L$. The following is an example of the rules of the maximum value filter.

```
IF      y_i = max(y_1, . . ., y_L) ≠ y_j
        {i ∈ (1, . . ., L), j = (1, . . ., L), i ≠ j}
  THEN      mode_i = 1
            mode_j = 0
            mode_unspecifiable = 0
  ELSE    mode_k = 0, {k = (1, . . ., L)}
          mode_unspecifiable = 1
```

In the above described equations, the outputs "mode_1", . . . , "mode_L" of the filter 41 correspond to the outputs $y_l$, . . . , $y_L$ of the NN 31. Moreover, sign "mode_unspecifiable" corresponds to "being impossible of specifying feature modes", and the output "mode_unspecifiable" of the filter 41 becomes the value of 1 in the case where there are two or more maximum values among the outputs of the NN 31. In this case, the number of the outputs of the filter 41 becomes larger than the number of the prepared feature modes by 1, that is to say it becomes Q=L+1.

The second filtering characteristic is the maximum value filter being an improvement of the first filtering characteristic. The state of "being impossible of distinguishing feature modes" cannot happen in the first filtering characteristic, but there are some cases where the determination of the feature modes by the use of the maximum value has no significance in case of the state of every output of the NN 31 being approximately the value of 0. In this case, it is reasonable to set a threshold value and to determine that the distinction of the feature modes is impossible when the maximum value of the outputs of the neurons is smaller the threshold value. An example of the rules of the improved maximum filter will be described hereinafter.

To a certain threshold value "th" (0<th<1):

```
IF        yi = max(y1, . . ., yL) ≠ yj and yi ≧ th
          {i ∈ (1, . . ., L), j = (1, . . ., L), i ≠ j}
  THEN        mode_i = 1
              mode_j = 0
              mode_unspecifiable = 0
              mode_unresolvable = 0
  ELSE IF     yi = yj = max(y1, . . ., yL) ≧ th
              {i, j ∈ (1, . . ., L), i ≠ j}
      THEN        mode_k = 0, {k = (1, . . ., L)}
                  mode_unspecifiable = 1
                  mode_unresolvable = 0
  ELSE        mode_k = 0, {k = (1, . . ., L)}
              mode_unspecifiable = 0
              mode_unresolvable = 1
```

In the equations above described, the outputs "mode_1", . . . , "mode L" of the filter 41 correspond to the outputs $y_1$, . . . , $y_L$ of the NN 31. Moreover, sign "mode_unspecifiable" corresponds to "being impossible of specifying feature modes", and the output "mode_unspecifiable" of the filter 41 becomes the value of 1 in the case where there are two or more maximum values among the outputs of the NN 31. Furthermore, sign "mode_unresolvable" corresponds to the "being impossible of distinguishing feature modes", and the output "mode_unresolvable" of the filter 41 takes the value of 1 when the maximum value of the outputs of the NN 31 is smaller than the threshold value. Besides, sign "th" designates a threshold value. In this case, the number of the outputs of the filter 41 becomes larger than the number of the prepared feature modes by two, namely becomes Q=L+2.

The third filtering characteristic is a threshold value filter which has a set threshold value and makes the output value of the filter 41 the value of 1 which output of the filter 41 corresponds to the output of the NN 31 larger than the threshold value. In this case, the cases of the "being impossible of specifying feature modes" and the "being impossible of distinguishing feature modes" happen. And, some rules to select the case of the "being impossible of specifying feature modes" can be considered. Two kinds of examples among them will be described hereinafter, but as a matter of course the rules to select the case of the "being impossible of specifying feature modes" are not limited to the two.

At first, the first threshold value filter is designated as the threshold value filter 1. In the threshold value filter 1, the case of the "being impossible of specifying feature modes" is selected when there are two or more outputs taking larger values than the threshold value among the outputs $y_1$, . . . , $y_L$ of the NN 31. The rules of the threshold value filter 1 will be described as follows.

To a certain threshold value "th" (0<th<1):

```
IF        yi ≧ th and yj < th
          {i ∈ (1, . . ., L), j = (1, . . ., L), i ≠ j}
  THEN        mode_i = 1
              mode_j = 0
              mode_unspecifiable = 0
              mode_unresolvable = 0
  ELSE IF     yi ≧ th and yj ≧ th
              {i, j ∈ (1 , . . ., L), i ≠ j}
      THEN        mode_k = 0, {k = (1, . . ., L)}
                  mode_unspecifiable = 1
                  mode_unresolvable = 0
  ELSE        mode k = 0, {k = (1, . . ., L)}
              mode_unspecifiable = 0
              mode_unresolvable = 1
```

In the equations above described, sign "mode_ unspecifiable" designates an output of the filter 41 corresponding to the "being impossible of specifying feature modes", and sign "mode_ unresolvable" designates an output of the filter 41 corresponding to the "being impossible of distinguishing feature modes". Besides, sign "th" designates a threshold value.

Next, the second threshold value filter is designated as the threshold value filter 2. In the threshold value filter 2, the case of the "being impossible of specifying feature modes" is selected when there are two or more outputs taking larger values than a certain threshold value among the outputs $y_1$, . . . , $y_L$ of the NN 31 and when the total sum of the output values of the NN 31 exceeds another threshold value. The rules of the threshold value filter 2 will be described as follows.

To certain threshold values "$th_0$", "$th_1$" ($0<th_1 \leqq th_0<1$) and "$th_2$" ($0<th_2<L$):

```
IF        yi ≧ th0 and yj < th1
          {i ∈ (1, . . ., L), j = (1, . . ., L), i ≠ j}
  THEN        mode_i = 1
              mode_j = 0
              mode_unspecifiable = 0
              mode_unresolvable = 0
  ELSE IF     Σyk ≧ th2 {k = (1, . . ., L)}
      THEN        mode_k = 0, {k = (1, . . ., L)}
                  mode_unspecifiable = 1
                  mode_unresolvable = 0
  ELSE        mode_k = 0, { k = (1, . . ., L)}
              mode_unspecifiable = 0
              mode_unresolvable = 1
```

In the equations above described, sign "mode_ unspecifiable" designates an output of the filter 41 corresponding to the "being impossible of specifying feature modes", and sign "mode_ unresolvable" designates an output of the filter 41 corresponding to the "being impossible of distinguishing feature modes". Besides, signs "$th_0$" and "$th_1$" designate threshold values to the output values of the NN 31, and sign "$th_2$" designates a threshold value to the total sum of the output values of the NN 31. These threshold values may be same or different from each other.

The fourth filtering characteristic does not take the outputs $y_1$, . . . , $y_L$ of the NN 31 as the inputs to the filter 41, but takes the ratios of each output value to the total output value. In this case, if the inputs to the filter 41 are designated by the reference signs $z_1$, . . . , $z_L$, the input $z_i\{i=(1, \ldots, L)\}$ is expressed as the following equation, and the rules of the filter 41 are aforementioned each characteristic the input $y_i$ of which is modified to the input $z_i$ corresponding to the input $y_i$.

$$z_i=y_i/\Sigma y_i$$

The aforementioned parameters such as the threshold values and the like of the filter 41 can be adjusted by trial and error or by online learning after the system began to operate so that the case of the "being impossible of specifying feature modes" or the "being impossible of distinguishing feature modes" becomes fewer.

The feature mode specifying means 42 in the feature mode detecting means 23 specifies one feature mode out of the outputs of the filter 41 in conformity with the following rules.

IF mode_i=1 ($1 \leqq i \leqq L$)

THEN select the feature mode i

However, the filter 41 is in the state of the "being impossible of specifying feature modes" or the "being impossible of distinguishing feature modes" in case of mode_j=1 ($L<j \leqq Q$}, and consequently, the feature mode specifying means 42 cannot select a feature mode. In such a case, the feature mode specifying means 42 may select the feature mode, for example, having been selected the prior time.

After the feature mode is distinguished in the feature mode distinguishing part 14 as mentioned above, the control parameter setting part 16 executes the set processing of control parameters in STEP ST4. That is to say, the control parameter setting means 27 in the control parameter setting part 16 selects the previously set optimum control parameters out of the control parameter table 26 in accordance with the distinguished feature mode, and sets the selected control parameters to the drive controlling part 12. The drive controlling part 12 executes the group supervisory control of elevators on the basis of the set control parameters at STEP ST5.

Furthermore, the correction of the distinction function of feature modes by means of learning is periodically practiced apart from these daily controls in STEP ST6. Such correction may be practiced after finishing the daily control, or may be done every specified terms, for example every week.

Figure 10:
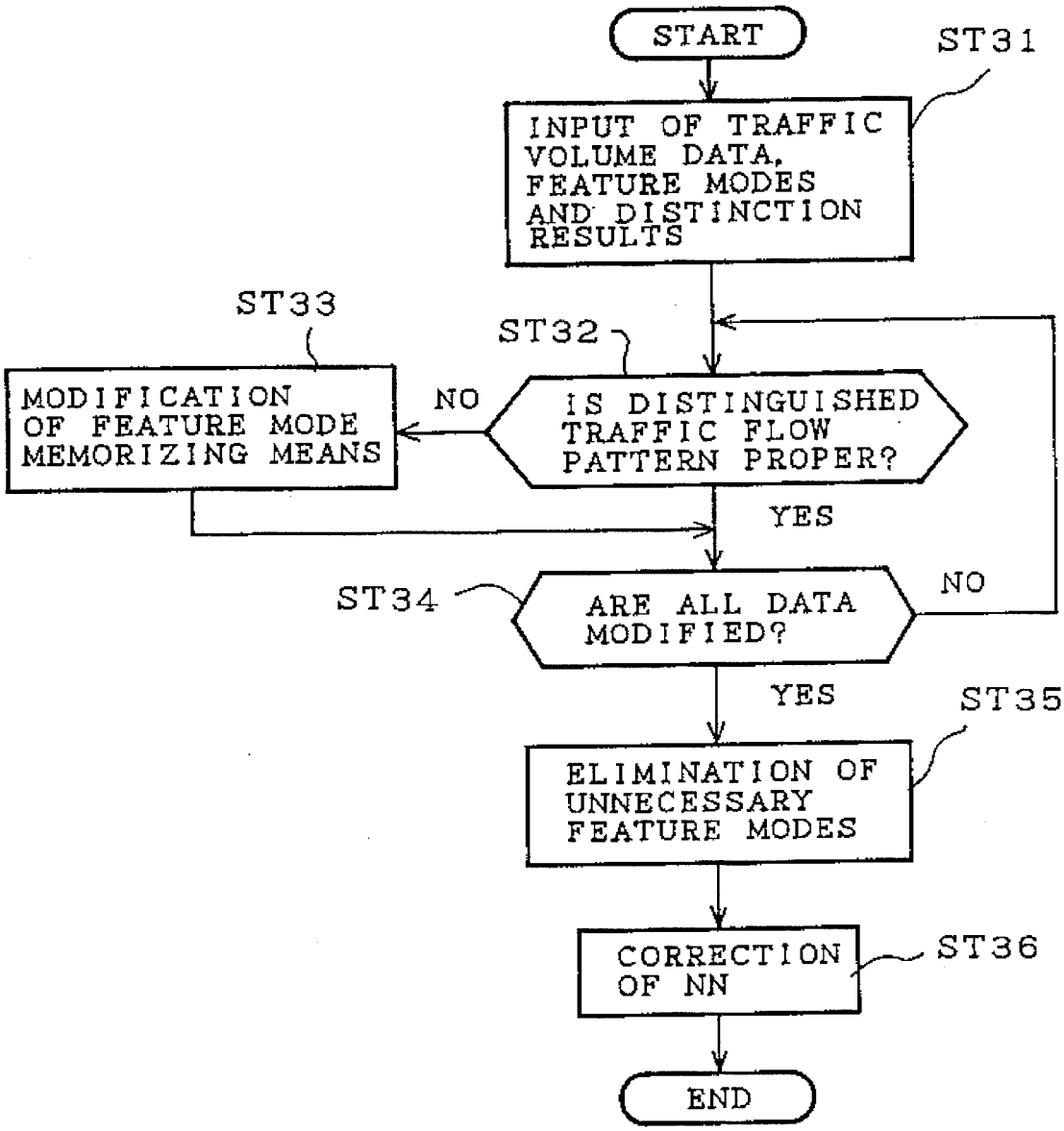
FIG. 10 is a flowchart showing the correction procedures of the distinction function in the group supervisory control procedures of elevators.

Hereinafter, the detail of the periodical correction procedures of the distinction function will be described with the flowchart of FIG. 10 referred.

At first, the following data are monitored in advance to be inputted to the distinguishing function constructing part 15 in STEP ST31: namely, each traffic volume data detected by the traffic volume detecting means 13 and inputted to the feature distinguishing part 14 in the past, the feature data distinguished to each of the traffic volume data, and the output values of the NN 31 in the feature mode distinguishing means 21 (aforementioned $y_1, \ldots, y_L$). And, whether distinguished each feature mode was proper or not is verified by the use of these data at STEP ST32, and the contents of the feature mode memorizing means 22 are modified at STEP ST33 in case of being determined not to be proper.

Thereby, the verification of the propriety at STEP ST32 is, to be concrete, executed by the use of, for example, specified threshold values $h_{max}$, $h_{min}$ (for example, $h_{max}=0.9$, $h_{min}=0.1$) as follows. Now, for instance, supposing that the feature mode distinguished from a certain traffic volume datum is $T_m$. As described above, the output values of NN 31 ($y_1, \ldots, y_L$) correspond to the similarities between traffic volume data and each feature mode registered in the feature mode memorizing means 22, and accordingly, if only one output value corresponding to the distinguished feature mode (herein output $y_m$) among the output values $y_1, \ldots, y_L$ takes a value larger than the threshold value $h_{max}$ and the other output values are smaller than the threshold value $h_{min}$ as the next equation, the distinction results are determined to be proper.

$$y_m > h_{max},\ y_k < h_{min}\ (k=1, \ldots, L,\ k \neq m)$$

Otherwise, the number of the feature modes registered in the feature mode memorizing means 22 is determined to be insufficient, and an inputted time zone is newly made to be a feature mode and registered into the feature mode memorizing means 22 together with the traffic volume data at that time at STEP ST33. Besides, by executing a simulation, the optimum control parameters to the newly registered feature mode are registered to the control parameter table 26. These procedures of STEPs ST32 and ST33 are repeated until the procedures are determined at STEP ST34 to be finished to all of the data inputted at STEP ST31.

Moreover, in the case where the traffic volume of the time zone appointed to be a certain feature mode has changed owing to the environmental changes of the building or secular changes, and the traffic volume data similar to any other feature mode become to be observed, the time zone is determined to be unnecessary to be a feature mode, then the feature mode is eliminated from the feature mode memorizing part 22 at STEP ST35. The procedures of STEPs ST31 to ST35 are executed by the feature mode setting part 25 in the distinction function constructing part 15. If the contents of the feature mode memorizing part 22 are renewed as the results of the procedures of STEPs ST31 to ST35, the learning means 24 corrects the NN 31 by learning through the similar procedures to those of STEPs ST12 to ST14 shown in FIG. 8, then the correction procedures of traffic flow feature mode distinction function at STEP ST6 in FIG. 7 are finished.

The NN 31 and the feature mode memorizing part 22 can always be kept proper by executing the above mentioned procedures of correction, then the distinction accuracy of the traffic flow feature mode distinction function can be kept good. The aforementioned is all of the group supervisory control procedures shown in FIG. 7.

Hereinafter, the control parameters in elevator group supervisory control will be described.

In elevator group supervisory control, the improvement of the service of the traffic in buildings is promoted by selecting and assigning proper elevators to each hall call generated at each floor. Evaluation functions are usually used to the selection of the assigned elevators. The method using the evaluation functions is a method having the following steps: namely, the step of assigning each elevator to the latest hall call for the time of being; the step of totally evaluating the service states anticipatable after the assignment such as the waiting time of passengers at each hall, failures of predictions, passing through because of no vacancy, and the like by the use of evaluation functions for example shown below; and the step of selecting elevators taking the best evaluation value.

$$J(i)=W_a \times f_w(i)+W_b \times f_y(i)+W_c \times f_m(i)+\ldots$$

J(i): the total evaluation value when the ith elevator is assigned for the time of being $f_w(i)$: the evaluation of the anticipatable waiting time of each passenger when the ith elevator is assigned for the time of being $f_y(i)$: the evaluation of the anticipatable failures of predictions when the ith elevator is assigned for the time of being $f_m(i)$: the evaluation of the passing through because of no vacancy when the ith elevator is assigned for the time of being $W_a$, $W_b$, $W_c$: weight parameters for the evaluation of the waiting time, the evaluation of the failures of predictions and the evaluation of the passing through because of no vacancy respectively In the above mentioned equation, reference signs $W_a$, $W_b$, $W_c$ are weight parameters designating the degrees of serious consideration for each kind of the evaluation items such as the waiting time and the like. The setting of these weight parameters has a great influence upon control results, for example setting the weight parameter $W_a$ for the waiting time high would enable to shorten the average waiting time but would enlarge the failures of predictions and the passing through because of no vacancy, and the like.

Furthermore, the control parameters in the elevator group supervisory control are not limited to the above mentioned weight parameters of the evaluation functions. For example, in office buildings and the like, it is generally practiced to raise the allocation efficiency of cars to the lobby floor, where traffic congestion is anticipated, by allocating plural elevators or dividing the stoppable floors of each elevator or the like in the opening time zone. It is also practiced to forward elevators to the specified floors in the lunch time zone or in the closing time zone. The settings of the numbers of allocation elevators to the lobby floor, stoppable floors and forwarding floors are also important control parameters in the elevator group supervisory control.

As for the optimum values (or calculated values) of these control parameters, the method of the present invention enables to obtain the optimum values of the control parameters to each traffic flow feature mode in advance by simulations and the like.

EMBODIMENT 2

Next, the embodiment 2 of the present invention will be described by the use of drawings. FIG. 11 is a block diagram showing the construction of an embodiment of the invention to be described claim 8. In FIG. 11, the corresponding elements to those of FIG. 2 are denoted by the same reference numerals as those of FIG. 2 and the description of them will be omitted.

In FIG. 11, reference numeral 17 designates a control result detecting part detecting the control results and the drive results of each elevator as traffic means. Reference numeral 18 designates a control parameter setting part being different from the control parameter setting part denoted the reference numeral 16 in FIG. 2 in the point of not only setting control parameters for the optimum group supervisory control of elevators to the drive controlling part 12, but also executing the correction of the control parameters on the basis of the control results and the drive results detected by the control result detecting part 17. Besides, the group supervisory controlling apparatus 1 is composed of these control result detecting part 17, control parameter setting part 18, drive controlling part 12, traffic volume detecting part 13, feature distinguishing part 14 and distinction function constructing part 15. Furthermore, reference numeral 4 designates a user interface, connected to the group supervisory controlling apparatus 1, for exhibiting the reference data such as the control results and the drive results detected by the control result detecting part 17 to a user and for receiving the directions of the user to set and correct the control parameters.

Figure 12:
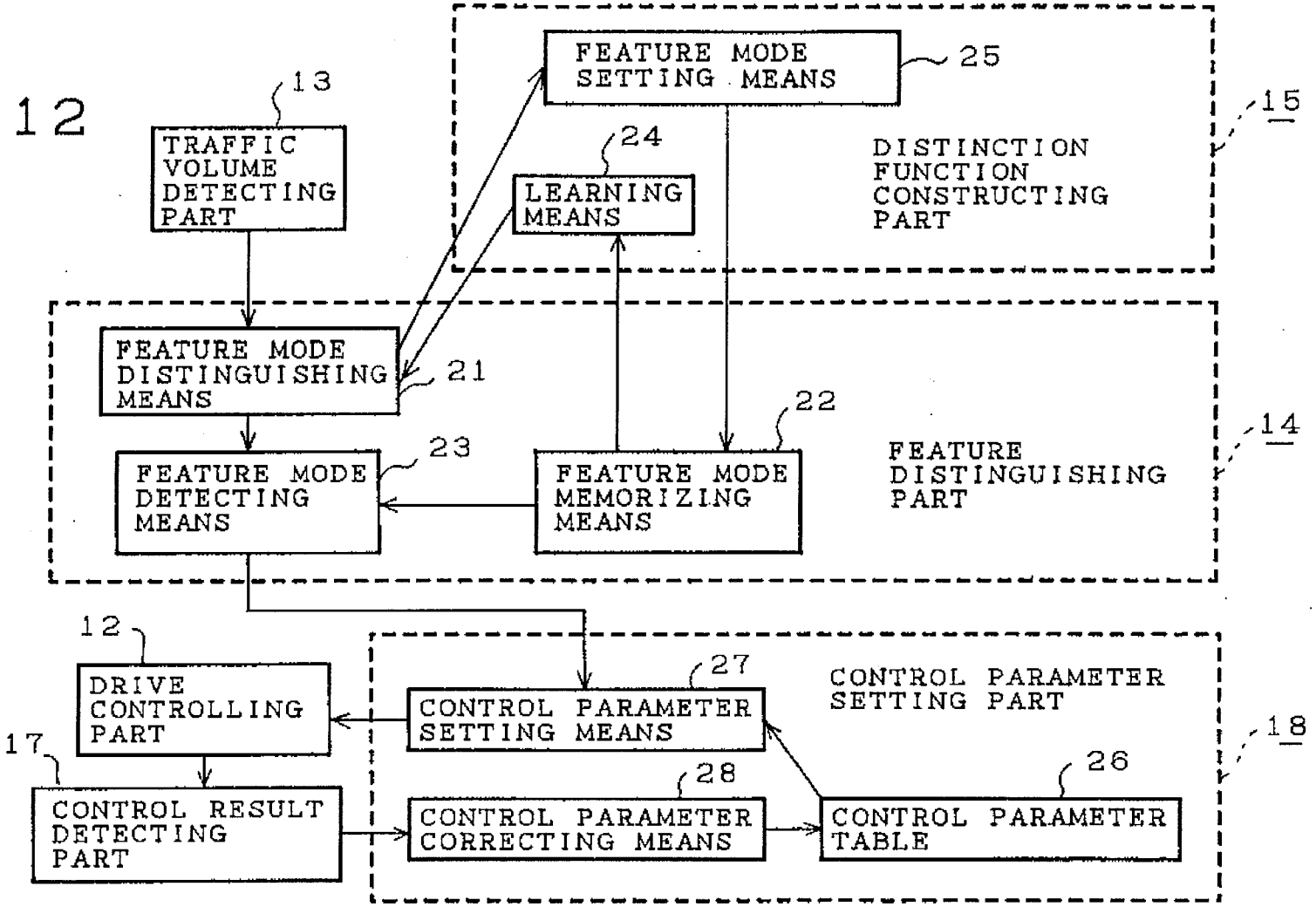
FIG. 12 is a block diagram showing the construction of the group supervisory controlling apparatus of the embodiment 2.

FIG. 12 is a block diagram showing the detailed construction of the group supervisory controlling apparatus 1 of FIG. 11, this case also, the elements corresponding to those of FIG. 3 are denoted by the same reference numerals as those of FIG. 3, and the description of them will be omitted.

In FIG. 12, reference numeral 28 designates a control parameter correcting means correcting the control parameters set in the drive controlling part 12 and correcting the contents of the control parameter table 26 on the basis of the control results and the drive results detected by the control result detecting part 17. The control parameter setting part 18 is composed of the control parameter correcting means 28, the control parameter table 26 and the control parameter setting means 27.

Figure 13:
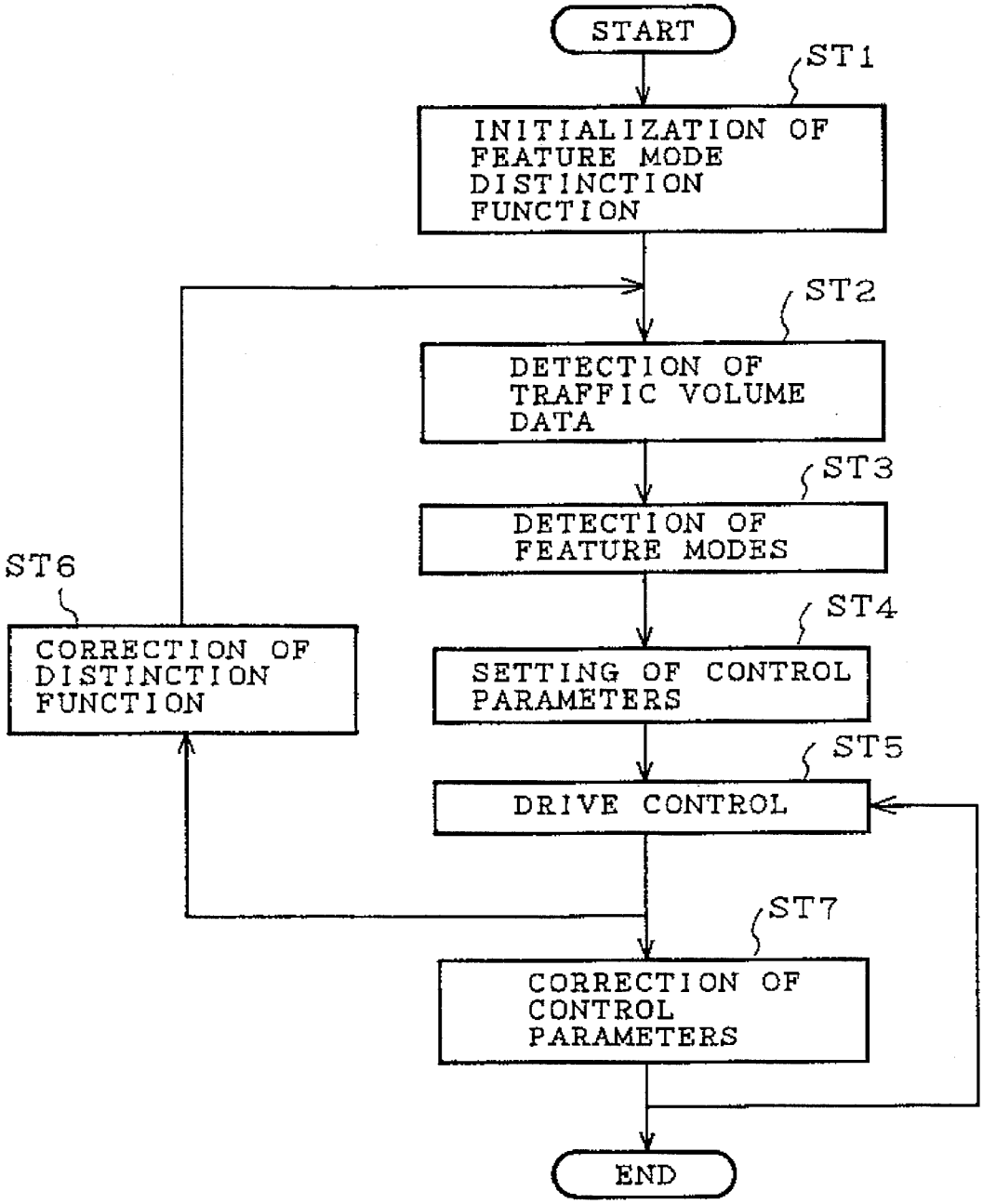
FIG. 13 is a flowchart showing the outline of the group supervisory control procedures of elevators in the embodiment 2.
Figure 14A:
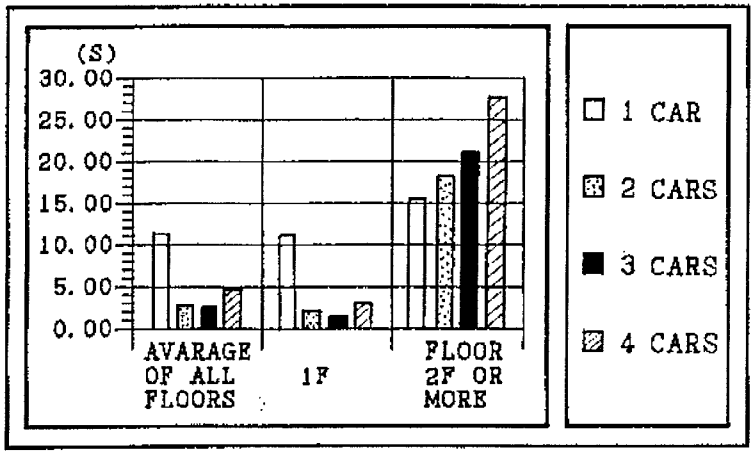
FIG. 14(*a*), FIG. 14(*b*), FIG. 14(*c*), FIG. 14(*d*) and FIG. 14(*e*) are explanatory drawings showing examples of the control results and the drive results of the group supervisory control of elevators in the example 2 by simulations.
Figure 14B:
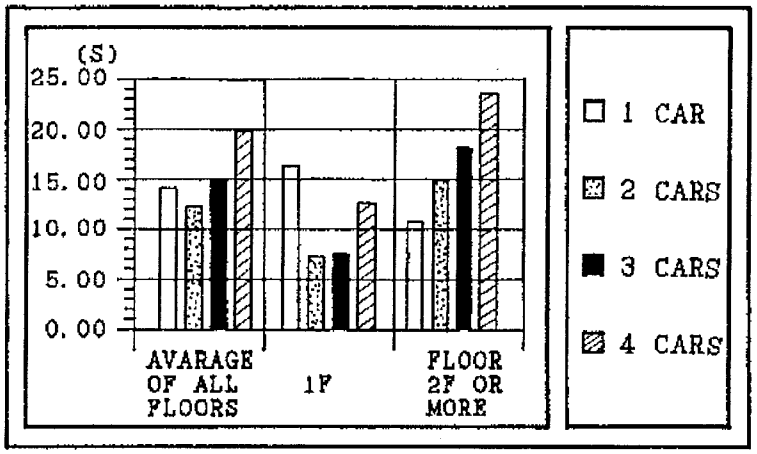
Figure 14C:
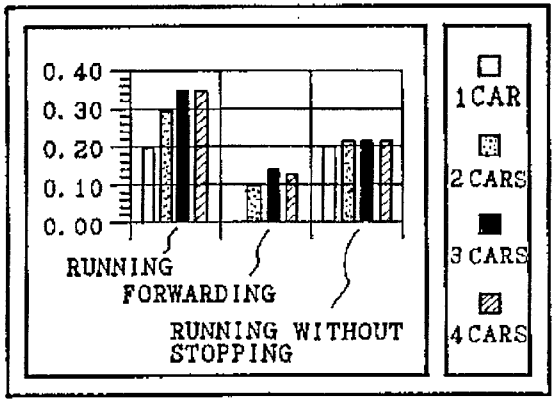
Figure 14D:
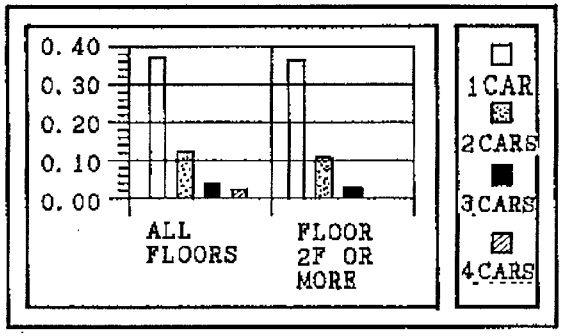
Figure 14E:
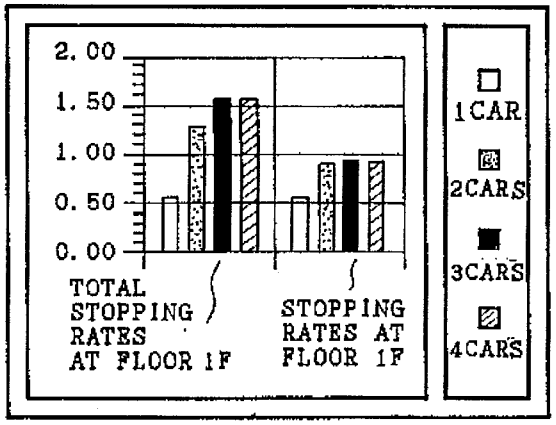

Next, the operation will be described thereof. FIG. 13 is a flowchart showing the outline of the group supervisory control procedures of elevators of the embodiment 2, and the same processes as those of the embodiment 1 are denoted by the same step numerals as those of the corresponding steps of FIG. 7.

Before beginning the control, the initialization of the distinction function of the feature distinguishing part 14 is executed at STEP ST1. The initialization of the distinction function is executed in conformity with the procedures shown in the flowchart of FIG. 8 like in the case of embodiment 1. In the daily control after such procedures of the initialization of the distinction function, at first in STEP ST2, the traffic volume detecting part 13 detects the estimated traffic volume data G in the prescribed time zones on the day when the control is done, and transmits the detected traffic volume data G to the feature distinguishing part 14. The feature distinguishing part 14, which has received the traffic volume data, distinguishes which feature mode the traffic volume data belongs to at STEP ST3. This procedures of the feature mode distinction is also executed in conformity with the procedures shown in the flowchart of FIG. 9 like in the case of the embodiment 1.

After the feature mode is distinguished in the feature mode distinguishing part 14 as mentioned above, the control parameter setting part 18 executes the set processing of control parameters in STEP ST4. That is to say, the control parameter setting means 27 in the control parameter setting part selects the previously set optimum control parameters out of the control parameter table 26 in accordance with the distinguished feature mode, and sets the selected control parameters to the drive controlling part 12. The drive controlling part 12 executes the group supervisory control of elevators at STEP ST5 on the basis of the thus set control parameters. The control results of the execution of the group supervisory control and the drive results of each elevator are detected by the control result detecting part 17 to be transmitted to the control parameter setting part 18. The control parameter setting part 18, which received the detected control results and drive results, corrects the control parameters by the control parameter correcting means 28 of the control parameter setting part 18 at STEP ST7.

Hereinafter, this correction procedure of the control parameters will be described. As mentioned above, the control parameters can previously be set by executing simulations and the like according to feature modes. Therein, it is determined in actual controls which feature mode the detected traffic volume data correspond to. However, the detected traffic volume data definitely are the data similar to the traffic volume data corresponding to the representative feature mode memorized in the feature mode memorizing means 22, and do not accord with the feature mode completely. Consequently, some errors could happen between the traffic volume data and the feature modes. In such cases, the control parameter correcting means 28 in the control parameter setting part 18 corrects the control parameters at STEP ST7. This correction of the control parameters is executed according to the control results of the group supervisory control of elevators executed at STEP ST5 and the drive results of each elevator by referring the control parameters set at STEP ST4 as the standard values.

Now, the correction of the control parameters can be made by means of online tuning or offline tuning.

Next, the correction of the control parameters by means of online tuning will be described. The control results (hereinafter referred to as E) and the drive results of each elevator (hereinafter referred to as $E_v$) are monitored in order every unit time (for example, every 5 minutes) for all time zones in which equal feature modes were detected at STEP ST3. Then, if the control result E or the drive result $E_v$ satisfies prescribed conditions at a certain unit time, the values of the control parameters are increased or decreased from the standard values in accordance with the control result or the drive result. Thus, the values of the control parameters are corrected from the standard values by means of online tuning in accordance with the control results and the drive results detected in real time, and thereafter the control is executed using the corrected values in the time zones at which the equal feature modes are detected. The described is the correction of the control parameters by means of online tuning.

Moreover, the control results E and the drive results $E_v$ are monitored in order for all time zones in which equal feature modes were detected at STEP ST3. Then, if the control result E or the drive result $E_v$ satisfies prescribed conditions, the standard values of the control parameters are altered in accordance with the control result or the drive result, and the contents of the control parameter table 26 are renewed. The described is the correction of the control parameters by means of offline tuning.

By executing such corrections of the control parameters in order, the group supervisory control of elevators using the control parameters suitable for the characteristics of the building becomes capable of being practiced.

Furthermore, the concrete examples of the correction of the control parameters will be described. Now, the numbers of the allocation of elevators to the lobby floor in an office building at the opening time zone will be considered as an example of the control parameters. Great many passengers generally visit the lobby floor in this time zone. Accordingly, it is often practiced to promote the improvement of the transportation efficiency at the lobby floor by allocating (or forwarding) plural elevators to the lobby floor in this time zone. Such a system is generally called Lobby Floor Plural Elevator Allocation System. How many elevators are allocated at the lobby floor has an influence upon the transportation efficiencies of the whole building in this Lobby Floor Plural Elevator Allocation System.

It is required to consider the following items for determining the optimum number of elevators allocated to the lobby floor.

That is:

* service situations to each floor
* the allowance of equipment for traffic demand
* drive situations at the lobby floor
* the degree of the concentration of the equipment to the lobby floor.

As mentioned above, the Lobby Floor Plural Elevator Allocation System promotes the improvement of the service to the lobby floor by concentrating the equipment to the lobby floor by means of the forwarding of elevators. If there are surpluses of the equipment to some extent, the allocation of the appropriate number of elevators to the lobby floor would bring about a great deal of improvement of the service. But, if there are few surpluses of the equipment, the allocation of many elevators to the lobby floor would bring about a change for the worse in the service to the floors other than the lobby floor as the result of over concentration of the equipment to the lobby floor. Accordingly, it is considered to be proper that the allocation number of elevators to the lobby floor should be corrected from the prescribed standard values in conformity with, for example, the following rules.

[CORRECTION RULE 1]

IF ( (the allowance of the equipment is large)
and (the drive situation at the lobby floor is not good)
and (the service situations to the floors other than the lobby floor are good)
and (the concentration degree of the equipment to the lobby floor is not high) )
THEN (increase the concentration degree of the equipment to the lobby floor)

[CORRECTION RULE 2]

IF ( (the allowance of the equipment is small)
and (the drive situation at the lobby floor is good)
and (the service situations to the floors other than the lobby floor are bad)
and (the concentration degree of the equipment to the lobby floor is high) )
THEN (decrease the concentration degree of the equipment to the lobby floor)

Each item included in the aforementioned conditions can concretely be denoted by the aforementioned control results E indicating the general service situations of the group supervisory control system and the drive results $E_v$ indicating how each elevator has run and stopped.

FIG. 14(*a*) to FIG. 14(*e*) are explanatory drawings showing the simulation results of the elevators' behaviour at the opening time zone in a standard building equipped with six elevators. And, FIG. 14(*a*) to FIG. 14(*e*) shows the compared results in each case where the number of the allocated elevators to the lobby floor is changed (from one to four). (The lobby floor is the first floor 1F in this case. Hereinafter, the lobby floor is designated by reference sign 1F. And, the floors of the second and more are designated by reference signs 2F, 3F, . . . in order). Therein, that the number of the allocated elevators is one means the ordinary allocation system where plural elevators are not allocated. FIG. 14(*a*) shows the average waiting time of passengers, FIG. 14(*b*) shows the unresponding time to hall calls, and FIGS. 14(*c*) to 14(*e*) show some examples of the drive results. The average waiting time shown in FIG. 14(*a*) is generally incapable of being observed, however the other control results E and drive results Ev are observable.

For example, following data are observable as the control results E and the drive results $E_v$.

That is:

control results: E=(r, h, m)

r: the distribution of the unresponding time to hall calls h: the number of times of the failures of predictions m: the number of times of passing through because of no vacancy drive results: Ev=($A_v$, $A_{v2}$, Run, $R_{st1}$, $R_{st2}$, $P_{st0}$, $P_{st}$)

$A_v$: waiting rate $A_{v2}$: the waiting rate of the floor 2F or more

Run: total running time $R_{st1}$: stopping rate at the floor 1F $R_{st2}$: total stopping rate at the floor 1F $P_{st}$: the number of times of the departures from the floor 1F $P_{st0}$: the number of times of the departures from the floor 1F without passengers Each item included in each condition of the aforementioned [CORRECTION RULE 1] and the [CORRECTION RULE 2] can be denoted for example as follows with the control results E and the drive results $E_v$.

* service situations to each floor [the distribution r of the unresponding time to the hall calls of the control results E]

The waiting time of each passenger is suitable for indicating service situations, but it is incapable to measure the respective waiting time of each passenger. Then, the service situations are generally indicated by the unresponding time to hall calls. However, the waiting time and the unresponding time at the floors other than the floor 1F considerably accord with each other but they do not accord with each other at the floor 1F, as shown in FIG. 14(*a*) and FIG. 14(*b*). This is why many passengers often gets on by the one hall call at the floor 1F. In the case where plural elevators are allocated at the floor 1F, in particular, the elevators are allocated to the floor 1F without hall calls at the floor 1F, and consequently, the unresponding time to hall calls is not suitable for being used as the index for evaluating the service situations at the floor 1F. Then, for example, the drive situations at the lobby floor 1F, which will be described later, can be considered to be used as the replaceable index with the unresponding time to hall calls.

* the allowance of equipment for traffic demand [waiting rate $A_v$, the waiting rate of the floor 2F or more $A_{v2}$, total running time Run]

The waiting rate $A_v$ indicates the ratio of the average value of the (total) time when each elevator is in a waiting state with its door closed (out of operation state) to control time. For example, if the control time is one hour and each elevator is in its waiting state during half an hour totally on an average, the waiting rate $A_v$ becomes 0.5. Besides, that the waiting rate $A_v$ is 0 is the state where every elevator is fully operating without becoming out of operation state once, and that the waiting rate $A_v$ is 1 conversely means the state where each elevator operates at no time. Similarly, the waiting rate of the floor 2F or more $A_{v2}$ indicates the ratio of the waiting state at the floors 2F or more.

Because plural elevators are for being allocated to the floor 1F, the more the number of the allocated elevators becomes, generally, the longer the time required for forwarding them and the longer the total running time Run becomes (FIG. 14(*c*)). As a result, the time when the elevators are in the waiting state inevitably decrease as shown in FIG. 14(*d*). In particular, the waiting time at the floors 2F or more becomes shorter. Moreover, the forwarding time does not increase in the case where the number of allocated elevators is larger than a specified value. This is why the waiting time at the floors 2F or more is lost and the allowance for executing the forwarding becomes 0. Consequently, it can be considered that there is room for further improvement of the transportation efficiency to the floor 1F by increasing the allocated elevators, if the waiting rate at the floors 2F or more $A_{v2}$ is large. Conversely, when the waiting rate at the floors 2F or more $A_{v2}$ is small, it is not expectable to improve the transportation efficiency to the floor 1F, even if the allocated elevators are further increased. That the waiting rate $A_v$ (or the waiting rate $A_{v2}$) is larger or that the running time Run is smaller means that the allowance of equipment is larger.

* the drive situations at the lobby floor [stopping rate at the floor 1F $R_{ct1}$, the number of times of the departures from the floor 1F $P_{st}$]

The stopping rate at the floor 1F $R_{st1}$ indicates the ratio of the total value of the time when at least one elevator is in a stopping state (including a waiting state or a passengers' getting off state) at the floor 1F to the control time. For example, if the control time is one hour and the total value of the time when at least one elevator is in a stopping state at the floor 1F is half an hour, the stopping rate at the floor 1F $R_{st1}$ becomes 0.5. Generally, the larger the stopping rate at the floor 1F $R_{st1}$ is, the longer the time capable of getting on at the floor 1F. Consequently, that the stopping rate at the floor 1F $R_{st1}$ is larger is considered to be that the transportation efficiency to the floor 1F is higher and that the the drive situations are better. Moreover, the number of times of the departures from the floor 1F $P_{st}$ indicates the number of elevators departing from the floor 1F per unit time. Generally, that the number of times of the departures from the floor 1F $P_{st}$ are many means that the elevators are accordingly allocated to the floor 1F more frequently and that the drive situation to the floor 1F is good.

* the degree of the concentration of equipment to the lobby floor [total stopping rate at the floor 1F $R_{st2}$, the number of times of the departures from the floor 1F without passengers $P_{st0}$]

The total stopping rate st the floor 1F $R_{st2}$ indicates the ratio of the sum (total) value of the stopping time of each elevator at the floor 1F to the control time. For example, in the case where the control time is one hour and each elevator totally stopped at the floor 1F for one hour and a half, the total stopping rate at the floor 1F $R_{st2}$ becomes 1.5. This total stopping rate at the floor 1F $R_{st2}$ indicates the degree of the concentration of the equipment to the lobby floor (1F). The total stopping rate at the floor 1F $R_{st2}$ generally increases by increasing the number of the allocated elevators to the floor 1F, but the aforementioned total stopping rate at the floor 1F $R_{st2}$ does not so much increase as shown in FIG. 14(*e*) in the case where the number of the allocated elevators to the floor 1F reaches to a specified value. This is why the cases where plural elevators stop at the floor 1F increase. Accordingly, it is useless to allocate too much elevators at the floor 1F. It results the change of the transportation efficiency to the floors 2F or more for worse on the contrary as shown in FIG. 14 (*a*) and FIG. 14 (*b*).

Further, the number of times of the departures from the floor 1F without passengers $P_{st0}$ indicates the number of elevators which departed from the floor 1F with taking no passengers. That the number of times of the departures from the floor 1F without passengers $P_{st0}$ are large means that the elevators departed from the floor 1F without taking passengers are many although they had been forwarded to the floor 1F, accordingly it means that too much elevators are allocated to the floor 1F. This number of times of the departures from the floor 1F without passengers $P_{st0}$ can also be considered to be the index indicating the degree of the concentration of the equipment.

The aforementioned [CORRECTION RULE 1] and the [CORRECTION RULE 2] can concretely expressed, for example as follows by the use of above mentioned control results E and the drive results Ev.

[CORRECTION RULE $R_1$]

| | |
|---|---|
| IF | { (waiting rate $A_{v\,2}$ is large)<br>and (stopping rate at the floor 1F $R_{s\,i\,1}$ is not large)<br>and (the average unresponding time of the floors 2F or more is short)<br>and (total stopping rate at the floor 1F $R_{s\,t\,2}$ is not large) } |
| THEN | {increase the number of the allocated elevators to the floor 1F by one} |

[CORRECTION RULE $R_2$]

| | |
|---|---|
| IF | { (waiting rate $A_{v\,2}$ is small)<br>and (stopping rate at the floor 1F $R_{s\,t\,1}$ is large)<br>and (the average unresponding time of the floors 2F or more is long)<br>and (total stopping rate at the floor 1F $R_{s\,t\,2}$ is large) } |
| THEN | {decrease the number of the allocated elevators to the floor 1F by one} |

The first condition (waiting rate $A_{v2}$ is large) of the [CORRECTION RULE $R_1$] can be expressed as follows by the use of, for example, a specified threshold value.

$(A_{v2}>Th)$ Th: threshold value $(0<Th<1)$

Similarly, the second and after conditions of the [CORRECTION RULE $R_1$] can be expressed by the use of the prescribed threshold values. Furthermore, it is also able to express the conditions by the use of fuzzy sets corresponding to the states being "large" or "small". This is similarly applied to [CORRECTION RULE $R_2$].

Furthermore, the correction rules are not limited to the aforementioned [CORRECTION RULE $R_1$] and [CORRECTION RULE $R_2$]. That is to say, plural correction rules can be expressed using other indexes of the control results E and the drive results $E_v$ as mentioned above. In this case, it can be considered to make plural rules having the same execution section as "increase the number of the allocated elevators" like in, for example, [CORRECTION RULE $R_1$]. In the case where plural rules being equivalent in meaning exist, the case where the conditions of two or more rules are concurrently satisfied can happen. In such cases, one of the rules the condition of which is satisfied may be executed.

Furthermore, the rules of the aforementioned [CORRECTION RULE $R_1$] and [CORRECTION RULE $R_2$] can be used in the online tuning or the offline tuning of the correction procedure of the control parameters at STEP ST7 in FIG. 13. That is to say, the aforementioned control results E and the drive results Ev are monitored, for example every five minutes, and when they satisfy the conditions of each correction rule, the number of the allocated elevators is increased or decreased by one at that time point. Similarly, the control results E and the drive results Ev are monitored over all time zones of the traffic flow feature modes detected at STEP ST3. Thereby, when the control results E and the drive results $E_v$ the conditions of each correction rule, the standard value of the number of the allocated elevators to the floor 1F can be altered to alter the contents of the control parameter table 26 of FIG. 12.

Besides, the threshold values in each correction rule need not necessarily be the same value in case of being used in the online tuning and in case of being used in the offline tuning. Similarly, in the case where the rules for the correction of the control parameters are expressed by fuzzy sets, too, different fuzzy sets may be used to express the rules in the online tuning and in the offline tuning.

The above mentioned correction of the control parameters is automatically executed by the elevator group supervisory controlling apparatus 1 of the traffic means controlling apparatus.

Moreover, apart from the correction described above, it is also capable for a user to execute the setting or correction of the control parameters through the user interface 4 from the outside with referring to the aforementioned control results E and the drive results $E_v$ exhibited on the user interface 4. In this case, each correction rule may be used as guides for the correction of the control parameters by the user by being exhibited to the user together with the control results E and the drive results Ev. Also, it may be applicable to construct the system so that the user can appoint the availability and the invalidity of each correction rule and can alter the threshold values of the rule conditions, the fuzzy sets and the like.

By executing such corrections, the control using the control parameters suitable for building characteristics can be executed.

The correction of the distinction function of feature modes by means of learning is periodically practiced in STEP ST6 of FIG. 13 apart from such dally controls. Such correction is also practiced after finishing the dally control, or is done every specified terms, for example every week in conformity with the flowchart of FIG. 10 like in the case of the embodiment 1.

EMBODIMENT 3

Figure 15:
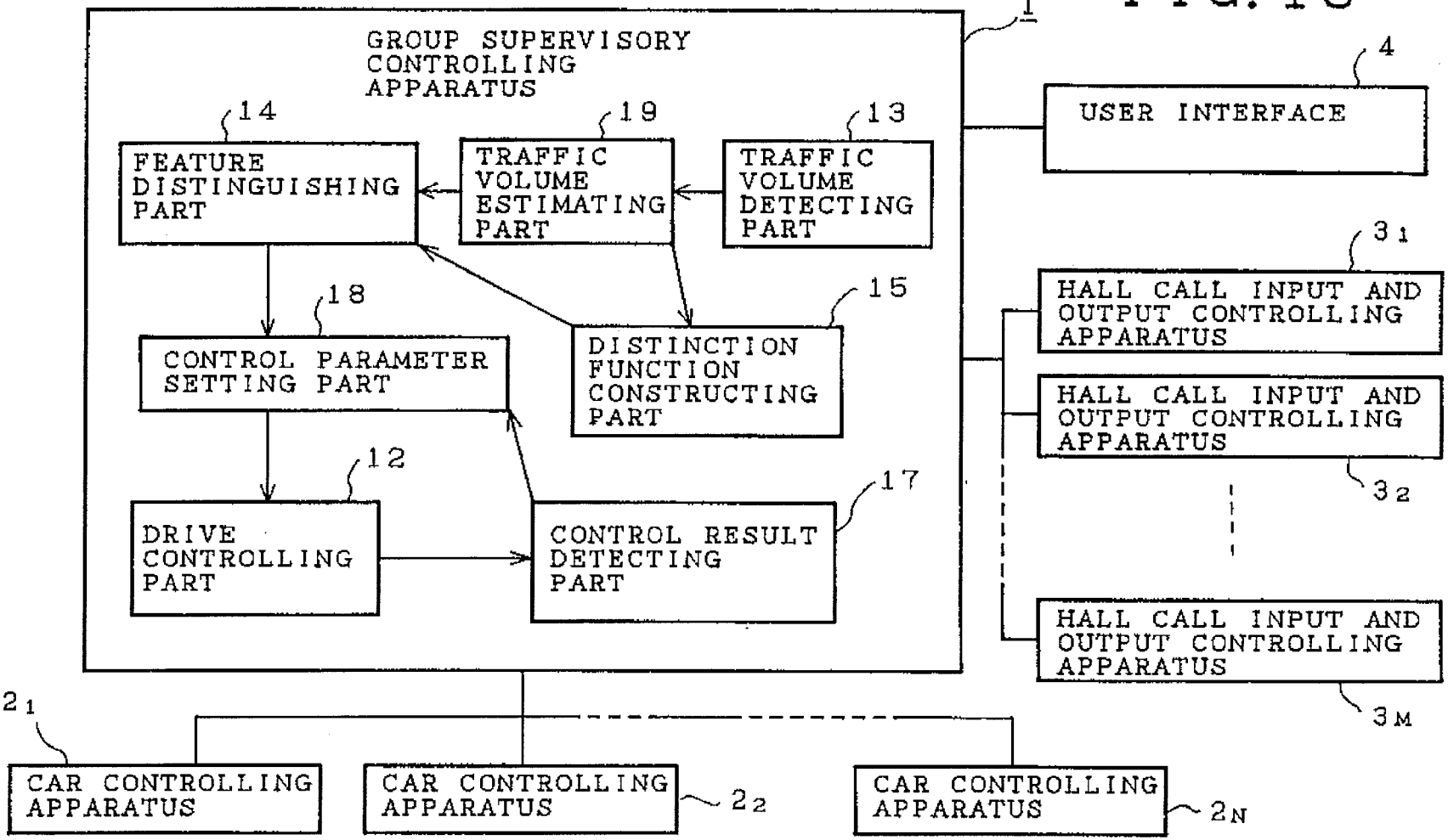
FIG. 15 is a block diagram showing the construction of the embodiment 3 of the traffic means controlling apparatus of the present invention applied to the group supervisory control of elevators.

Next, the embodiment 3 of the present invention will be described by the use of drawings. FIG. 15 is a block diagram showing the construction of an embodiment of the invention to be described claim 12. In FIG. 15, the corresponding elements to those of FIG. 11 are denoted by the same reference numerals as those of FIG. 11, and the description of them will be omitted.

In FIG. 15, reference numeral 19 designates a traffic volume estimating part estimating the traffic volumes in prescribed time zones on the day when the control is executed on the basis of the traffic volume data detected by the traffic volume detecting means 13, and the feature distinguishing part 14 distinguishes the feature modes of the traffic flows in the prescribed time zones from the traffic volume data estimated by the traffic volume estimating part 19. Besides, the group supervisory apparatus 1 is composed of these traffic volume detecting part 13, traffic volume estimating part 11, feature distinguishing part 14, distinction function constructing part 15, control parameter setting part 18, control result detecting part 17 and drive controlling part 12.

Figure 16:
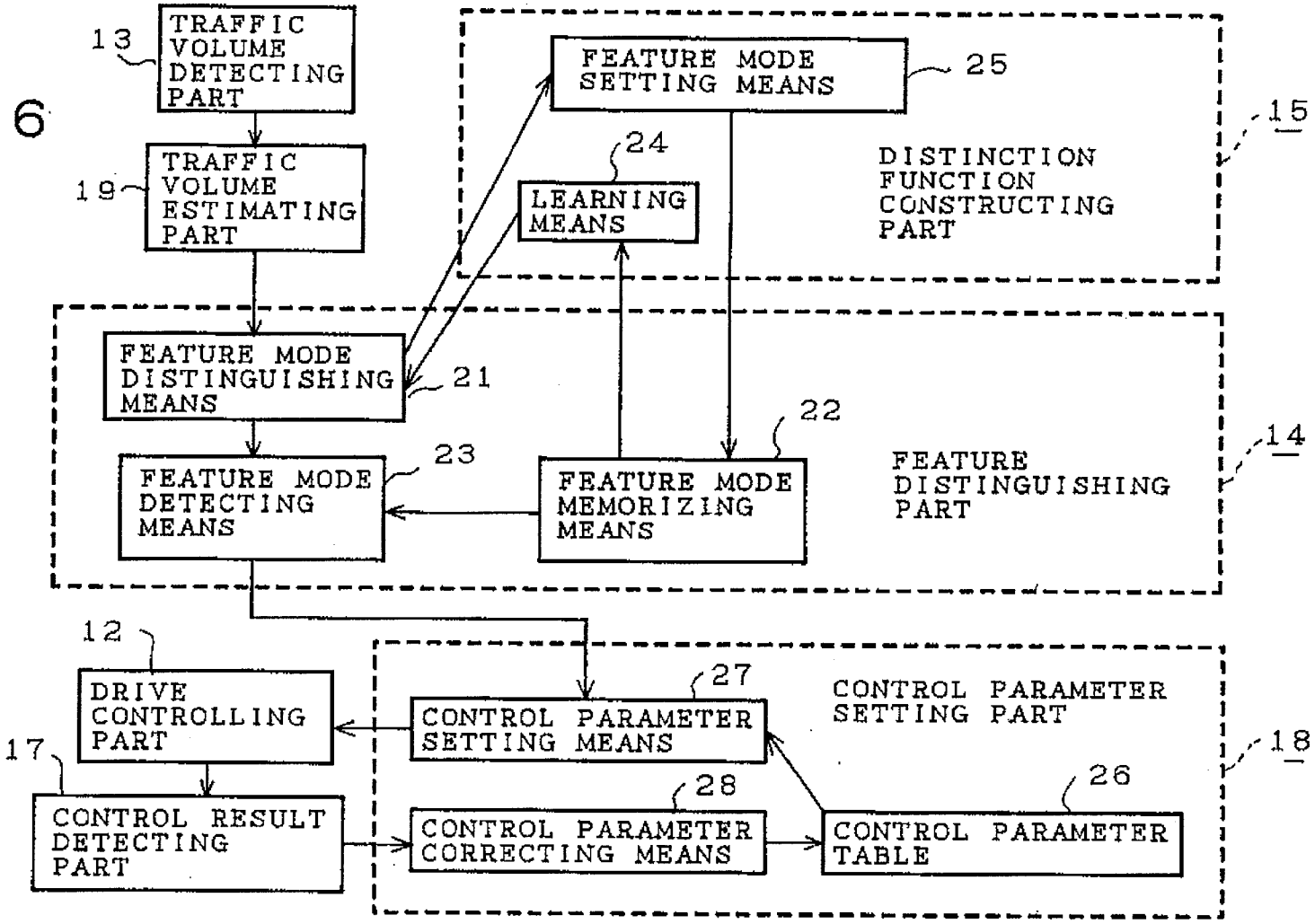
FIG. 16 is a block diagram showing the construction of the group supervisory controlling apparatus of the embodiment 3.

FIG. 16 is a block diagram showing the detailed construction of the group supervisory controlling apparatus 1 of FIG. 15, in this case also, the elements corresponding to those of FIG. 12 are denoted by the same reference numerals as those of FIG. 12, and the description of them will be omitted. In FIG. 16, the feature mode distinguishing means 21 distinguishes traffic flow feature modes from the traffic volume data estimated by the traffic volume estimating part 19 on the basis of the traffic volumes detected by the traffic volume detecting part 13.

Figure 17:
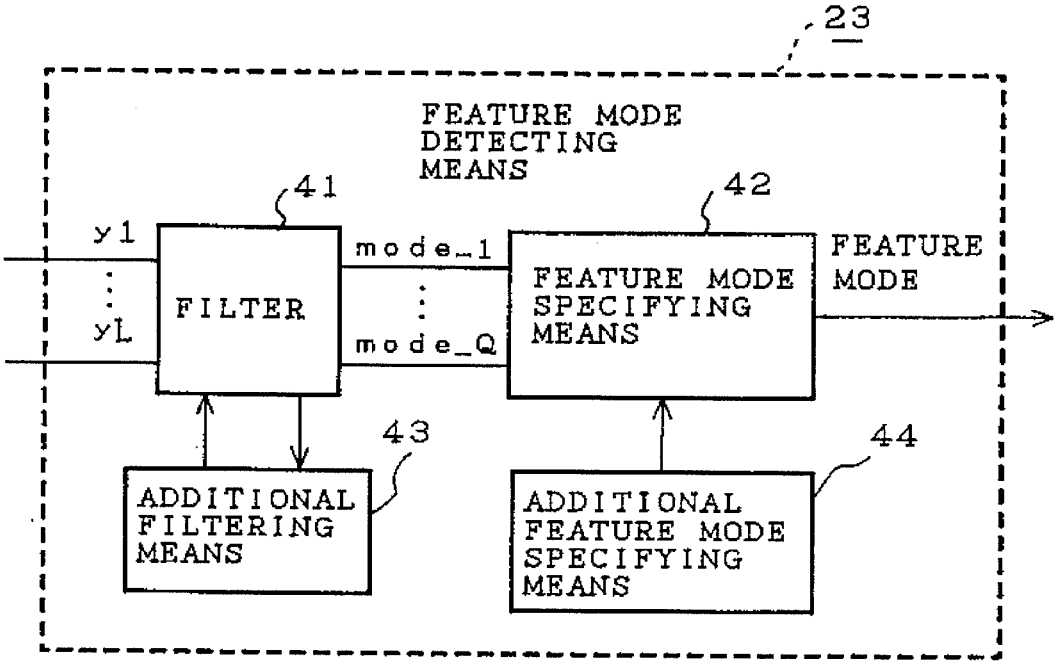
FIG. 17 is a block diagram showing the construction of the feature mode detecting means of the embodiment 3.

FIG. 17 is a functional block diagram showing the functional construction of the feature mode detecting means 23, in this case also, the elements corresponding to those of FIG.

5 are denoted by the same reference numerals as those of FIG. 5, and the description of them will be omitted. In FIG. 17, reference numeral 43 designates an additional filtering means correcting the function of the filter 41, and reference numeral 44 designates an additional feature mode specifying means correcting the function of the feature mode specifying means.

Next, the operation will be described thereof. Because many operations of this embodiment are same as the operations of the embodiment 2 described with the flowchart of FIG. 13, the repetitions of the description will be evaded, and only the different operations from those of the embodiment 2 will be described.

In the case of this embodiment, too, before beginning the control, the initialization of the distinction function of the feature distinguishing part 14 is executed at STEP ST1 of FIG. 13. In the daily control after such procedures of the initialization of the distinction function, at first in STEP ST2, the traffic volume detecting part 13 detects the traffic volumes on the day when the control is done, and the traffic volume estimating part 19 estimates the traffic volumes G in the near future in real time by executing the sampling processing of the detected traffic volumes.

Hereinafter, this estimation procedure of the traffic volumes will be described. At first, the traffic volume data G(−k), . . . , G(−1) in the past k minutes before the control time point (for instance k=5) are obtained by totalizing the detected traffic volumes, for instance, every one minute. Therein, reference sign G(−i) designates the traffic volume during the time from i minutes to i−1 minutes before. From them, the traffic flow datum G(0) at the control time point is obtained as follows by the use of, for instance, prescribed weights α (0<α<1).

$$G(0)=\Sigma(G(-i)\times\alpha_i)\ /\Sigma\alpha_i$$

And, the traffic volume for past unit time (k minutes; for instance k=5) including the traffic volume datum G(0), that is to say, $$G=G(0)+\ldots+G(-k+1)$$

is made to be the estimated traffic volume.

Besides, the methods of obtaining the estimated traffic volumes are not limited to the aforementioned method. For instance, the traffic volume for past unit time (k minutes) may simply be used as the estimated traffic volume. In this case, the estimated traffic volume becomes as follows:

$$G=G(-1)+\ldots+G(-k)$$

As another method, it is applicable to multiply the traffic volume datum G(0) obtained by the aforementioned method and "k" together to obtain G=k×G(0).

Then, the traffic volume data thus estimated are transmitted to the feature mode distinguishing part 14. The feature mode distinguishing part 14, which received the estimated traffic volume data, distinguishes which feature mode the traffic volume data belongs to at STEP ST3 in conformity with the procedures of the flowchart of FIG. 9.

Figure 9:
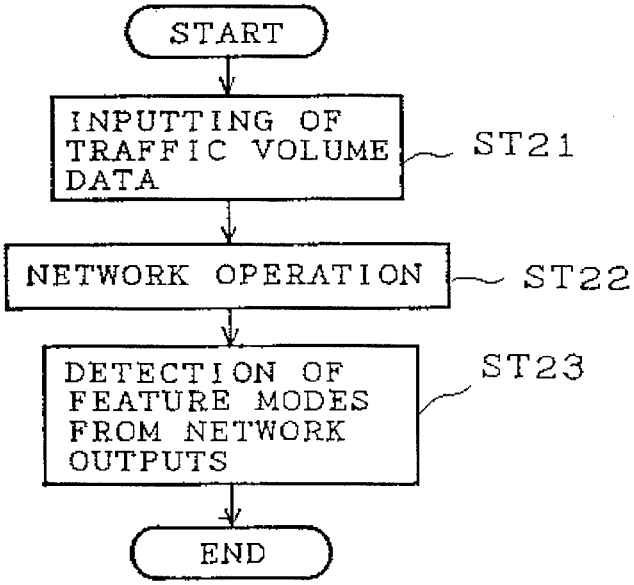
FIG. 9 is a flowchart showing the feature mode detection procedures in the group supervisory control procedures of elevators.

The procedures of the distinction of feature modes are executed in conformity of the flowchart shown in FIG. 9 similar to those of the embodiments 1 and 2.

The aforementioned estimated traffic volume data are inputted into the feature mode distinguishing means 21 at STEP ST21 of FIG. 9. After the feature mode distinguishing means 21 inputted the inputted traffic volume data to the datum transforming means 32 and transformed the data into each element $x_1, \ldots, x_n$ by the datum transforming means 32, the feature mode distinguishing means 21 inputs the transformed elements to the NN 31 and executes well-known network operations at the NN 31 at STEP ST22, and further the feature mode distinguishing means 21 transmits the output values $y_1, \ldots, y_L$ of the NN 31 to the feature mode detecting means 23.

In the feature mode detecting means 23, the filter 41 filters the output values $y_1, \ldots, y_L$ of the NN 31 and specifies a feature mode having the highest similarity like in the aforementioned embodiment 1 and 2.

In this embodiment, the filter function of the filter 41 is improved by the use of the additional filtering means 43 shown in FIG. 17. Next, the function of the additional filtering means 43 will be described. The additional filtering means 43 cannot select the feature modes by itself, but it can decrease the cases of the "being impossible of specifying feature modes" and the "being impossible of distinguishing feature modes" by means of being combined with the filter 41. Hereinafter, the function of the additional filtering means 43 is referred to as the additional threshold value filtering function.

At first, the additional threshold value filtering function 1 being the first additional threshold value filtering function will be described. This function is to do the re-selection of the feature modes by making the threshold values smaller in the case where the "being impossible of distinguishing feature modes" happens in the threshold value filter 1 or 2. Generally, making a threshold value smaller increases the cases of the "being impossible of specifying feature modes", and making a threshold value larger increases the cases of the "being impossible of distinguishing feature modes". Accordingly, the number of the cases of the "being impossible of specifying feature modes" or the "being impossible of distinguishing feature modes" is decreased by using a large threshold value usually and by using a smaller threshold value only when the case of the "being impossible of distinguishing feature modes" happens.

Now, as an example, the rules of the threshold value filter 3 which is composed by adding the additional threshold value filtering function 1 to the threshold value filter 1 will be described.

To a certain threshold value "th" (0<th<1) and the decreased amount of the threshold value "Δth_dec" (0≦Δth_dec<th):

```
IF        y_i ≧ th and y_j < th
            {i ∈ (1, . . ., L), j = (1, . . ., L), i ≠ j}
THEN      mode_i = 1
          mode_j = 0
          mode_unspecifiable = 0
          mode_unresolvable = 0
ELSE IF       y_i ≧ th and y_j ≧ th
          {i, j ∈ (1, . . ., L), i ≠ j}
     THEN     mode_k = 0, {k = (1, . . ., L)}
              mode_unspecifiable = 1
              mode_unresolvable = 0
ELSE IF       y_i ≧ th − Δth_dec and y_j < th − Δth_dec
```

-continued

```
            {i, j ∈ (1, . . ., L), i ≠ j}
    THEN    mode_i = 1
            mode_j = 0
            mode_unspecifiable = 0
            mode_unresolvable = 0
ELSE        mode_k = 0, {k = (1, . . ., L)}
            mode_unspecifiable = 0
            mode_unresolvable = 1
```

Therein, reference sign "mode_unspecifiable" designates an output of the filter 41 corresponding to the "being impossible of specifying feature modes", and reference sign "mode_ unresolvable" designates an output of the filter 41 corresponding to the "being impossible of distinguishing feature modes". Reference sign "th" designates a threshold value to an output of the NN 31, and the reference sign "Δth_dec" designates the quantity decreasing the threshold value "th" in case of executing re-selection.

The aforementioned threshold value filter 3 does not directly output the "being impossible of distinguishing feature modes" in the case where there are two or more output values of the NN 31 larger than the threshold value "th", but the threshold value filter 3 decreases the threshold value "th" to the threshold value "th−Δth_dec". And in the case where there is only one output value of the NN 31 larger than the decreased threshold value "th−Δth_dec", the threshold value filter 3 makes the output value of the filter 41 the value of 1, which output of the filter 41 corresponds to the output of the NN 31 larger than the decreased threshold value "th−Δth_dec". Thereby, the number of the case of the "being impossible of distinguishing feature modes" can be decreased.

Next, the additional threshold value filtering function 2 will be described. This function is to do the re-selection of the feature modes by making the threshold values larger in the case where the "being impossible of specifying feature modes" happens in the threshold value filter 1 or 2. Generally, making a threshold value smaller increases the cases of the "being impossible of specifying feature modes", and making a threshold value larger increases the cases of the "being impossible of distinguishing feature modes". Accordingly, the number of the cases of the "being impossible of specifying feature modes" or the "being impossible of distinguishing feature modes" is decreased by using a small threshold value usually and by using a larger threshold value only when the case of the "being impossible of specifying feature modes" happens.

Now, as an example, the rules of the threshold value filter 4 which is composed by adding the additional threshold value filtering function 2 being the second additional threshold value filtering function to the threshold value filter 1 will be described.

To a certain threshold value "th" (0<th<1) and the increased amount of the threshold value "Δth_inc" (0≦Δth_inc<th):

```
IF      y_i ≧ th and y_j < th
        {i ∈ (1, . . ., L), j = (1, . . ., L), i ≠ j}
THEN    mode_i = 1
        mode_j = 0
        mode_unspecifiable = 0
        mode_unresolvable = 0
ELSE IF     y_i ≧ th and y_j ≧ th
        {i, j ∈ (1, . . ., L), i ≠ j}
        THEN IF     y_i ≧ th + Δth_inc and y_j < th+Δth_inc
                    {i, j ∈ (1, . . ., L), i ≠ j}
                THEN    mode_i = 1
                        mode_j = 0
                        mode_unspecifiable = 0
                        mode_unresolvable = 0
        ELSE        mode_k = 0, {k = (1, . . ., L)}
                    mode_unspecifiable = 1
                    mode_unresolvable = 0
ELSE        mode_k = 0, {k = (1, . . ., L)}
            mode_unspecifiable = 0
            mode_unresolvable = 1
```

That is to say, this threshold value filter 4 does not directly output the "being impossible of specifying feature modes" in the case where there are two or more output values of the NN 31 larger than the threshold value "th", but the threshold value filter 3 increases the threshold value "th" to the threshold value "th+Δth_inc". And in the case where there is only one output value of the NN 31 larger than the increased threshold value "th+Δth_inc", the threshold value filter 3 makes the output value of the filter 41 the value of 1, which output of the filter 41 corresponds to the output of the NN 31 larger than the increased threshold value "th+Δth_inc". Thereby, the number of the case of the "being impossible of specifying feature modes" can be decreased.

Next, the additional threshold value filtering function 3 being the third additional threshold value filtering function will be described. This function is to do the re-selection of the feature modes by making the threshold value larger in the case where the "being impossible of specifying feature modes" happens or by making the threshold value smaller in the case where the "being impossible of distinguishing feature modes" happens in the threshold value filter 1 or 2.

Now, as an example, the rules of the threshold value filter 5 which is composed by adding the additional threshold value filtering function 3 to the threshold value filter 1 will be described.

To a certain threshold value "th" (0<th<1), the increased amount of the threshold value "Δth_inc" (0≦Δth_inc< th), and the decreased amount of the threshold value "Δth_dec" (0≦Δth_dec<th):

```
IF      y_i ≧ th and y_j < th
        {i ∈ (1, . . ., L), j = (1, . . ., L), i ≠ j}
THEN    mode_i = 1
        mode_j = 0
        mode_unspecifiable = 0
        mode_unresolvable = 0
ELSE IF     y_i ≧ th and y_j ≧ th
        {i, j ∈ (1, . . ., L), i ≠ j}
    THEN IF     y_i ≧ th + Δth_inc and y_j <th + Δth_inc
                {i, j ∈ (1, . . ., L), i ≠ j}
            THEN    mode_i = 1
                    mode_j = 0
                    mode_unspecifiable = 0
                    mode_unresolvable = 0
        ELSE        mode_k = 0, {k = (1, . . ., L)}
                    mode_unspecifiable = 1
                    mode_unresolvable = 0
ELSE IF     y_i ≧ th − Δth_dec and y_j < th − Δth_dec
        {i, j ∈ (1, . . ., L), i ≠ j}
    THEN    mode_i = 1
            mode_j = 0
            mode_unspecifiable = 0
            mode_unresolvable = 0
ELSE        mode_k = 0, {k = (1, . . ., L)}
            mode_unspecifiable = 0
            mode_unresolvable = 1
```

That is to say, in the case where there are two or more output values of the NN 31 larger than the threshold value "th" and further there are only one output value of the NN 31 larger than the increased threshold value "th+Δth_inc", this threshold value filter 5 makes the output value of the filter 41 the value of 1, which output of the filter 41 corresponds to the aforementioned output of the NN 31. Thereby, the number of the case of the "being impossible of specifying feature modes" can be decreased. Furthermore, in the case where the conditions described above are not satisfied and there are one output value of the NN 31 larger than the decreased threshold value "th−Δth_dec", the threshold value filter 5 makes the output value of the filter 41 the value of 1, which output of the filter 41 corresponds to the aforementioned output of the NN 31. Thereby, the number of the case of the "being impossible of distinguishing feature modes" can be decreased.

Next, the additional threshold value filtering function 4 will be described. This function is to do the selection of the feature modes as follows. That is to say, in the case where there are two or more output values of the NN 31 larger than the threshold value "th" in the threshold filter 1, or in the case where there are two or more output values of the NN 31 larger than the threshold value "$th_1$" in the threshold filter 2, and further if the difference of those outputs of the NN 31 being larger than the threshold values in each case exceeds another threshold value, the additional threshold value filtering function 4 selects the feature mode corresponding to the larger output of the NN 31. Thereby, the number of the case of the "being impossible of specifying feature modes" can be decreased.

Now, as an example, the rules of the threshold value filter 6 which is composed by adding the additional threshold value filtering function 4 being the fourth additional threshold value filtering function to the threshold value filter 1 will be described.

To certain threshold values "th" (0<th<1), "th_gap" (0≦th_gap<1−th):

```
IF      y_i ≧ th and y_j < th
        {i ∈ (1, . . ., L), j = (1, . . ., L), i ≠ j}
THEN    mode_i = 1
        mode_j = 0
        mode unspecifiable = 0
        mode_unresolvable = 0
ELSE IF     y_i ≧ th and y_j ≧ th
        {i, j ∈ (1, . . ., L), i ≠ j}
    THEN IF     y_m = max (y_i)
                y_m − max (y_j) ≧ th_gap
                    {i, j ∈ (1, . . ., L), m ≠ j}
                THEN    mode_m = 1
                        mode_j = 0
                        mode_unspecifiable = 0
                        mode_unresolvable = 0
        ELSE    mode_k = 0, {k = (1, . . ., L)}
                mode_unspecifiable = 1
                mode_unresolvable = 0
ELSE    mode_k = 0, {k = (1, . . ., L)}
        mode_unspecifiable = 0
        mode_unresolvable = 1
```

where reference sign "th_gap" designates the threshold value to the difference between the outputs "$y_i$" larger than the threshold value "th" in the case where there are two or more output values of the NN 31 larger than the threshold value "th".

In the case where there are two or more output values of the NN 31 larger than the threshold value "th", and further in the case where the difference of them is larger than the threshold value "th_gap", the threshold filter 6 makes the output of the filter 41 the value of 1, which output of the filter 41 corresponds to the larger output of the NN 31 among them. Thereby, the number of the case of the "being impossible of specifying feature modes can be decreased.

The aforementioned parameters of the filter 41 and the additional filtering means 43 can be modified by trial and error or by online learning so that the case of the "being impossible of specifying feature modes" or the "being impossible of distinguishing feature modes" becomes fewer after the system began to operate.

Next, the functions of the feature mode specifying means 42 and the additional feature mode specifying means 44 will be described.

The feature mode specifying means 42 in the feature mode detecting means 23 specifies one feature mode from the outputs of the filter 41 like in the aforementioned embodiment 1. Namely, in case of the "mode_i=1" (1≦i≦n), the feature mode specifying means 42 selects the feature mode "i" as the output of the feature mode detecting means 23. However, if the output of the filter 41 is "mode_j=1" (L<j≦Q), that output designates the state of the "being impossible of specifying feature modes" or the "being impossible of distinguishing feature modes", and consequently, any feature mode cannot be selected. In such cases, the final feature mode is decided by the additional feature mode specifying means 44. The additional feature mode specifying means 44 assigns suitable feature modes by the use of the informations concerning traffic flows in the case where the "being impossible of specifying feature modes" or the "being impossible of distinguishing feature modes" is selected by the feature mode specifying means 42. The selection rule of feature modes of the feature mode specifying means 42 is modified as follows by using the additional feature mode specifying means 44.

```
IF mode_i = 1 (1 ≦ i ≦ L)
    THEN (select the feature mode i)
ELSE IF mode_j = 1 (L < j ≦ Q)
IF mode_revise = i (1 ≦ i ≦ L, L < j ≦ Q)
    THEN (select the feature mode i)
```

Therein, reference sign "mode_revise" designates an output of the additional feature mode specifying means 44.

This modified selection rule of feature modes, as mentioned above, selects a feature mode out of the outputs of the additional feature mode specifying means 44 when the case of the "being impossible of specifying feature modes" or the "being impossible of distinguishing feature modes" is selected by the feature mode specifying means 42.

Although several kinds of the feature mode selection methods of the additional feature mode specifying means 44 can be considered, three of them will be described hereinafter. Provided that the feature mode selection methods of the additional feature mode specifying means 44 are not limited only to them.

The first method of them is time series correction method. This method is a method in which the feature modes selected in the past were memorized in the feature mode memorizing means 22 in advance and the selection of feature modes in the feature mode specifying means 42 is corrected on the basis of the past feature modes.

Although several kinds of the time series correction methods can also be considered, three of them will be described hereinafter. However, the time series correction methods are not limited only to them, too.

The first method of the time series correction methods is a method which makes the selection result of feature mode at the time just prior to the control time point this time feature mode successively.

The second method of the time series correction methods is a method in which the distinction results in the past several times (k times) from the control time point are memorized in the feature mode memorizing means 22 in advance and the feature mode continuously selected more than a specified times (herein referred to as C), if it exist, is made to be this time feature mode. An example of the rules of the time series correction method 2 being the second time series correction method is shown in the following equations.

IF mode (j)=mode (j–1) , . . . , mode (j–C) (0<j–C, j<k, C≧0)

THEN mode_revise = mode (j)

Therein, reference sign "mode(j)" designates the feature mode selected at the time point of j times prior to the control time point.

The third method of the time series correction methods is a method in which the distinction results in the past several times from the control time point are memorized in the feature mode memorizing means 22 in advance and the feature mode selected most frequently among the memorized feature modes is made to be this time feature mode.

Furthermore, the second selection method of feature modes of the additional feature mode specifying means 44 is time setting type correction method. This method is a method in which the selection results of the feature modes at the same time are monitored every day in advance and the feature mode selected most frequently is selected, or a method in which the feature mode to be selected is previously determined according to the time of a day.

The third selection method of feature modes of the additional feature mode specifying means 44 is traffic volume data observing type correction method deciding feature modes on the basis of the values of some specified feature elements of traffic volume data as conventionally practiced. The NN 31 generally decides feature modes according to the whole tendencies of traffic volume data. This traffic volume data observing type correction method decides accordingly feature mode on the basis of feature elements like prior arts only when the distinction result of the NN 31 is the case of the "being impossible of specifying feature modes" or the "being impossible of distinguishing feature modes".

The correction methods of the feature mode specifying means 42 described above may be used solely or may be used by combining some of them with each other.

After the feature mode is distinguished in the feature mode distinguishing part 14 as mentioned above, the control parameter setting part 18 executes the set processing of control parameters in STEP ST4. According to the control results of the execution of the group supervisory control and the drive results of each elevator, the control parameter setting part 18 corrects the control parameters at STEP ST7. Furthermore, the control parameter setting part 18 periodically corrects the feature mode distinction function at STEP ST6 apart from the aforementioned daily control.

EMBODIMENT 4

Next, another method of the elevator group supervisory control different from that of the embodiment 3 will be described as the fourth embodiment of the present invention.

Figure 18:
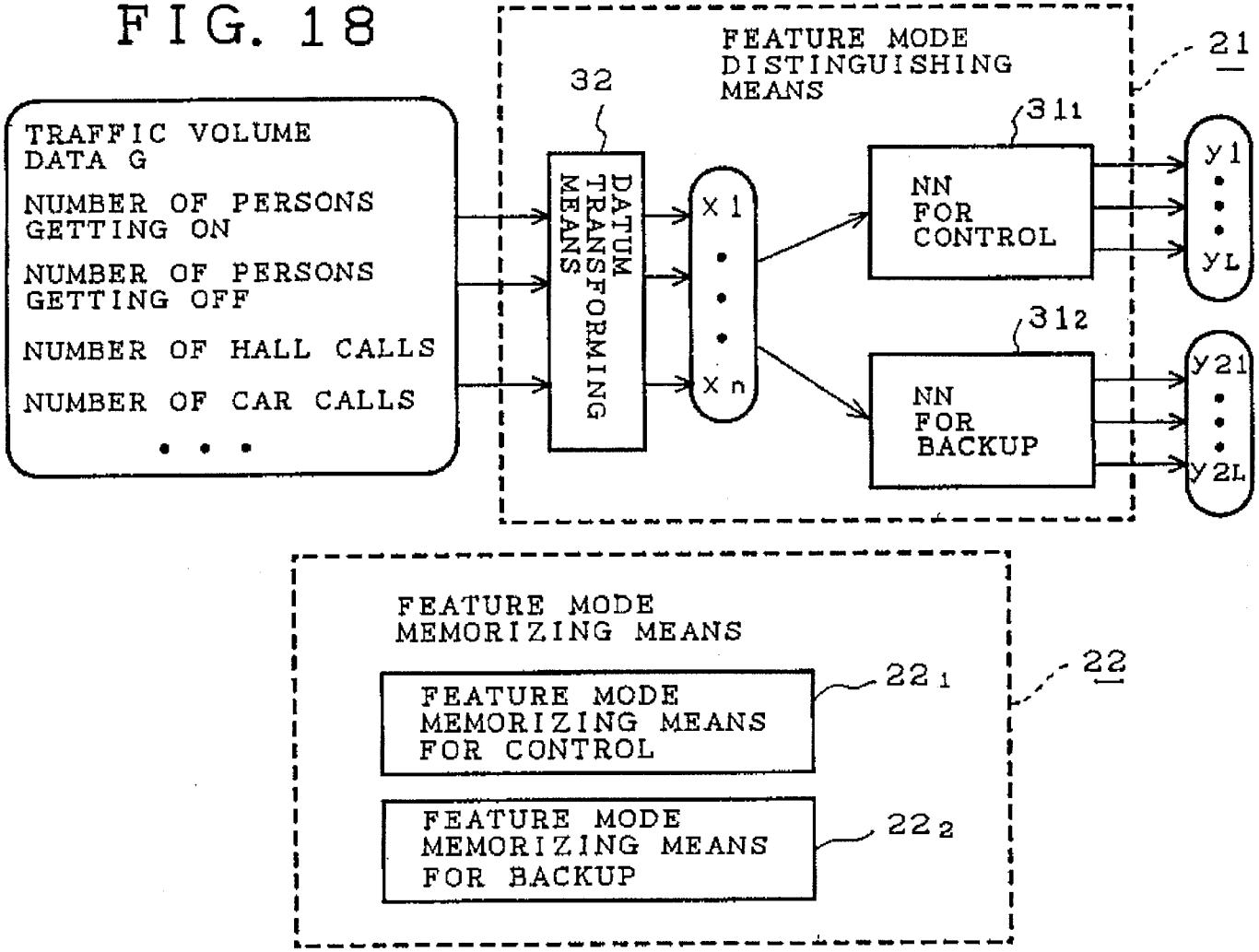
FIG. 18 is a block diagram showing the constructions of the feature mode distinguishing means and the feature mode memorizing means of the embodiment 4 of the present invention.

The construction of the traffic means controlling apparatus of this embodiment 4 is basically identical to that of the embodiment 3 (FIG. 15), accordingly the description concerning the basic construction of the embodiment 4 will be omitted. Provided that, this embodiment 4 differs from the corresponding parts of the above mentioned embodiment 3 in the following points. That is to say, as shown in FIG. 18, the feature mode distinguishing means 21 comprises two kinds of NNs of a NN for control $\mathbf{31}_1$ and a NN for backup $\mathbf{31}_2$, as described in claim 3, and the feature mode memorizing means 22 also comprises a feature mode memorizing means for control $\mathbf{22}_1$ and a feature mode memorizing means for backup $\mathbf{22}_2$. FIG. 18 is an explanatory drawing showing the constructions of the feature mode distinguishing means 21 and the feature mode memorizing means 22 of the embodiment 4.

Figure 19:
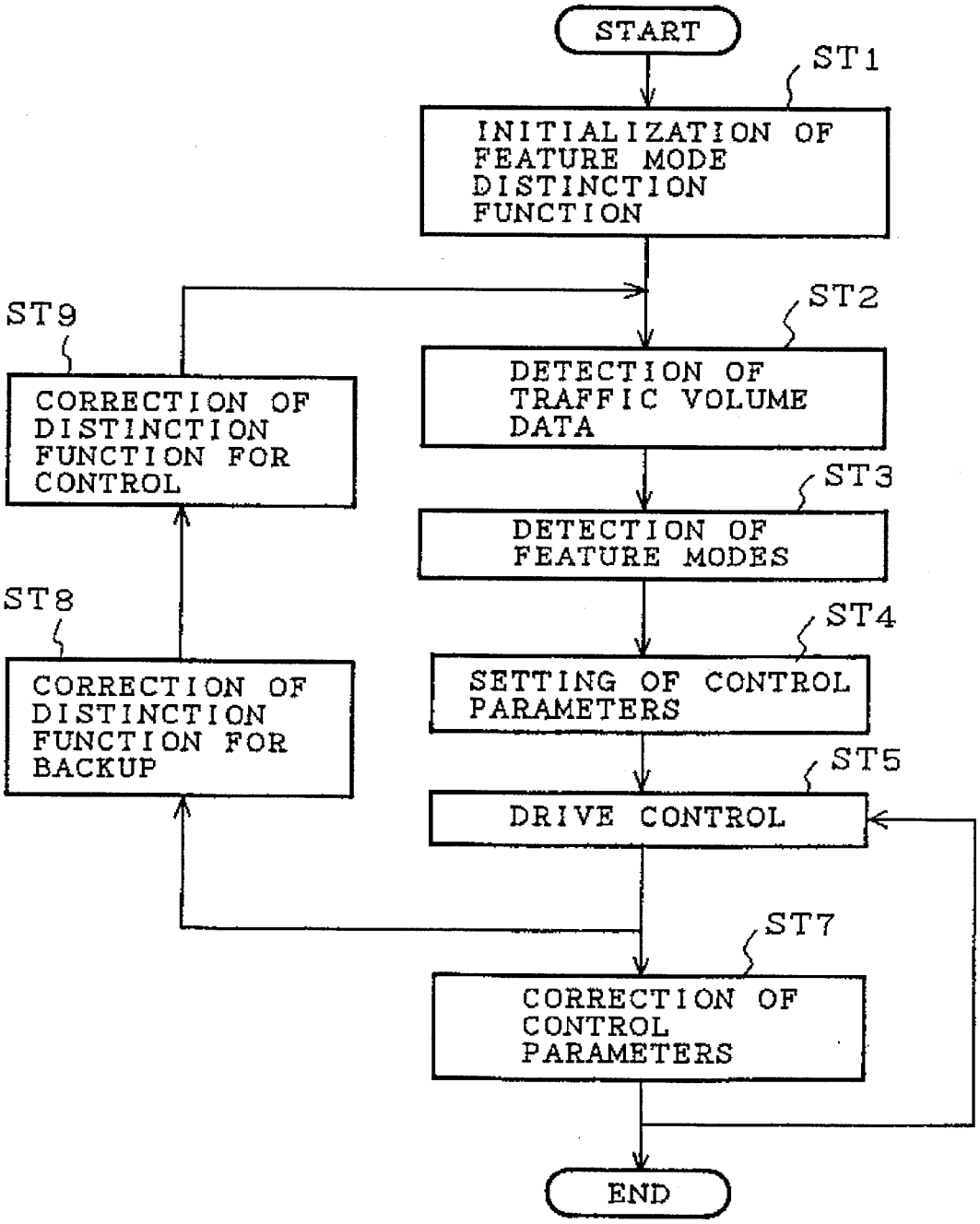
FIG. 19 is a flowchart showing the outline of the group supervisory control procedures of elevators in the embodiment 4.

Next, the operation of the embodiment 4 will be described. FIG. 19 is a flowchart showing the elevator group supervisory control procedures in the embodiment 4. In FIG. 19, processing steps identical to those of the embodiment 2 shown in the flowchart of FIG. 13 are numbered by the use of the same step numbers as those of the corresponding steps of FIG. 13, and the description concerning them will be omitted.

At first, before beginning the control, the distinction function of the feature mode distinguishing part 14 is initialized at STEP ST1. This initialization of the distinction function is executed in conformity with the procedures shown in the flowchart of FIG. 8 like in the embodiment 1. Provided that there are two kinds of the NNs in this embodiment 4, then the NN for control $\mathbf{31}_1$ and the NN for backup $\mathbf{31}_2$ are set to be quite equal in this initializing procedure (STEP ST1) in advance. Similarly, the feature mode memorizing means for control $\mathbf{22}_1$ and the feature mode memorizing means for backup $\mathbf{22}_2$ are also set to be quite equal.

In the daily control after finishing such initialization of the distinction function, the traffic volume detecting part detects the traffic volumes on the day in real time at first, then the traffic volume estimating part 18 estimates the traffic volumes G in the near future in real time by executing the sampling processing of the detected traffic volumes at STEP ST2. These procedures are also the same as those of the embodiment 3.

Next, the feature mode distinguishing part 14, which the traffic volumes G estimated by the traffic volume estimating part 19 are inputted to, distinguishes and detects which feature mode the traffic volumes G belongs to at STEP ST3. This feature mode distinction procedure is executed in conformity with the procedures of FIG. 10 like that of the embodiment 3. Provided that the control operation in this procedure is only executed by the use of the NN for control $\mathbf{31}_1$ in the feature mode distinguishing means 21 and the feature mode memorizing means for control $\mathbf{22}_1$ in the feature mode memorizing means 22, and the NN for backup $\mathbf{31}_2$ and the feature mode memorizing means for backup $\mathbf{22}_2$ are not used.

Next, after the detection of a feature mode was done at STEP ST3, the control parameter setting part 18 executes the set processing of the control parameters at STEP ST4. That is to say, the control parameter setting means 27 selects the previously set optimum control parameters out of the control parameter table 26 in accordance with the feature mode detected by the feature mode detecting means 23, and sets optimum control parameters into the drive controlling part 12.

The drive controlling part 12 executes the group supervisory control of elevators in accordance with the set control parameters at STEP ST5. Then, the control results of the group supervisory control and the drive results of each elevator are detected by the control result detecting part 17, and the detected control parameters and the drive results are transmitted to the control parameter setting part 18. In the control parameter setting part 18, which received the control results and the drive results, the control parameters are corrected by the control parameter correcting means 28 by the use of the online tuning or the offline tuning at STEP ST7. These procedures of STEPs ST4, ST5 and ST7 are executed similarly to those of the embodiment 2.

Furthermore, the correction of the distinction function is periodically done apart from this daily control at STEPs ST8 and ST9. At first, the NN for backup $31_2$ in the feature mode distinguishing means 21 and the feature mode memorizing means $22_2$ in the feature mode memorizing means 22 are corrected at STEP ST8. This correction procedure of STEP ST8 is done in conformity with the procedure of FIG. 10 similarly to the procedure of STEP ST6 of FIG. 7 in the embodiment 1. This correction is done only to the NN for backup $31_2$ of the feature mode distinguishing part 14 and the feature mode memorizing means for backup $22_2$ of the feature mode memorizing means 22, and the correction to the NN for control $31_1$ and the feature mode memorizing means for control $22_1$ are not done.

Then, the evaluations of the feature mode distinction functions of the NN for control $31_1$ and the NN for backup $31_2$ are done by the use of each of them respectively on a day other than the day when the correction procedure of STEP ST8 was done, and if it is determined that the feature mode distinction function using the NN for backup $31_2$ is superior to that using the NN for control $31_1$, the NN for control $31_1$ and the feature mode memorizing means for control $22_1$ are corrected by duplicating the contents of the NN for backup $31_2$ and the feature mode memorizing means for backup $22_1$ to the NN for control $31_1$ and the feature mode memorizing means for control $22_1$ or by replacing the contents of the NN for control $31_1$ and the feature mode memorizing means for control $22_2$ with the contents of the NN for backup $31_2$ and the feature mode memorizing means for backup $22_1$ respectively at STEP ST9.

The evaluations of the distinction functions on the basis of the two kinds of the NNs may be done, for instance, by monitoring the numbers of times of the "being impossible of specifying feature modes" and the "being impossible of distinguishing feature modes" appeared in the respective result, and by determining the distinction function having the fewer number of times of them to be superior. Because useless corrections can be omitted by executing the correction of the distinction function by the use of the two kinds of NNs in comparison with the case of using one kind of NN, effective corrections can be done. Thereby, the distinction accuracy of the distinguishing function can be kept in a good state.

EMBODIMENT 5

Figure 20:
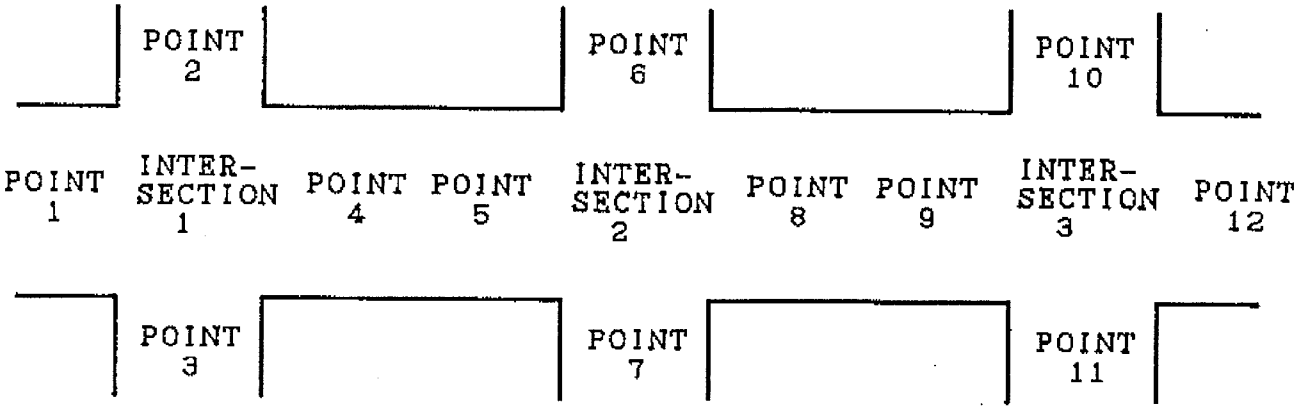
FIG. 20 is an explanatory drawing typically showing the road traffic to which the embodiment 5 of the present invention is applied.

The description of the above mentioned embodiments 1 to 4 were made about the case of the application of the present invention to the group supervisory control of elevators, but the present invention is also applicable to, for example, the signal control at each intersection of an arterial road as shown in FIG. 20. FIG. 20 is an explanatory drawing typically depicting an arterial road where the signal control is executed by the traffic means controlling apparatus of the present invention. In FIG. 20, the entrances and exits of each intersection are denoted as "point". Generally, in the road as shown in FIG. 20, the signal control is executed by utilizing the following traffic volume data, for instance.

traffic volume datum: G = (IN, OUT)

| | |
|---|---|
| IN = {INk} | INk: the number of cars flowing in to the point k |
| OUT = {OUTk} | OUTk: the number of cars flowing out from the point k |

The traffic flow feature modes of specified roads can be distinguished from the traffic volume data G by the use of a traffic controlling apparatus having functions basically equivalent to those of the embodiment 1 (namely, equivalent to those shown in FIG. 2). Consequently, the control parameters such as the cycle time of signals, intervals of green lights, and the like can appropriately be set.

Accordingly, the description of the details of the procedures of the distinction of traffic flow feature modes and the construction and the correction of the distinction function will be omitted, then the setting of control parameters will be described hereinafter.

For example, the following control parameters are used in the signal control of road traffic.

- cycle: the time of making a round from the green light to the red light through the yellow light
- split: the ratio of green light in a cycle [%]
- offset: the difference between the beginning times of each cycle at adjoining intersections
- right-turn aspect time: the displaying time of the arrow signal indicating right-turn Generally, the parameters "cycle" and the "split" of the signal control parameters mean the respective time and the distribution of changes from the green light to the red light through the yellow light of signals installed at each point surrounding an intersection. These control parameters influence the number of cars flown in and the turning to the right and the turning to the left of each car flown in at each intersection.

Besides, the parameter "offset" means the difference between the beginning times of each cycle at mutually adjoining intersections (for example, intersections 1, 2, 3 of FIG. 20) of an arterial road. Adjusting this "offset" properly would make it possible that, for example, a car having passed the intersection 1 uninterruptedly passes the intersections 2 and 3 in the green light successively.

There frequently happen the cases where cars waiting to turn to the right in an intersection or before the place of the intersection are obstacles for the following cars to pass, and the cars brings about traffic snarls in road traffic. In particular, in the case where cars waiting to turn to the right are ranged longer than the length of the lane dedicated to the cars turning to the right, a heavy traffic snarl is caused in high probability. In such a road, the traffic snarl can be prevented by setting the right-turn aspect time properly.

Similarly to the case of the embodiment 1, if the traffic flow feature modes can be distinguished, it would be possible to previously set the optimum values of the aforementioned control parameters by simulations. Also, the control parameters can be corrected in accordance with control results.

EMBODIMENT 6

Figure 21:
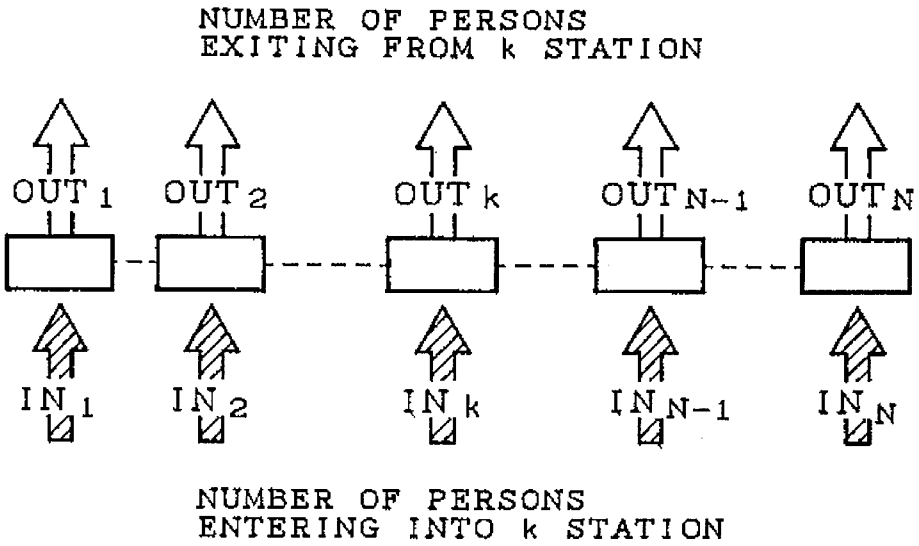
FIG. 21 is an explanatory drawing showing the concept of the control of railways to which the embodiment 6 of the present invention is applied.

Furthermore, the present invention can also be applied to the control in railways. In case of railways, the following numbers of persons entering and exiting from each station are observable traffic volume data as shown in FIG. 21.

traffic volume data: G = (IN, OUT)

| | |
|---|---|
| IN = {INk} | INk: the number of persons entering k-station |
| OUT = {OUTk} | OUTk: the number of persons exiting from the k-station |

Constructing a traffic means controlling apparatus basically having equivalent functions to the embodiment 1 (namely, equivalent to those shown in FIG. 2) makes it possible to distinguish the traffic flow feature modes from the traffic volume data G in the train group control of railways. Accordingly, the description of the details of the procedures of the distinction of traffic flow feature modes and the construction and the correction of the distinction functions will be omitted, then the description as to the control parameters will be made hereinafter. Now, the stoppage time and the adjustment amount of it will be described as an example.

In railways, each train is basically operated in conformity with a previously determined operation diagram, but actually it often happens that stoppage time is elongated longer than the scheduled time, for example, at a rush-hour in the morning because of the increasing of passengers getting on and off. In such a case, it is needed to operate the train group smoothly by uniformizing headways by adjusting the stoppage time and the rail time of each train, or by getting rid of the train stoppage between stations.

For example, at the point of time when it is estimated that the stoppage time of a train T at k-station will be elongated longer than the scheduled time, the headway between the train T axed the following train to the train T is controlled so as not to be shortened by adjusting the stoppage time and the rail time of the following train. Moreover, the headway between the train T and the preceding train to the train T is also controlled so as not to be enlarged by adjusting the stoppage time and the rail time of the preceding train. But each train gradually comes to be behind the operation diagram in case of being operated in conformity with such a control method. Accordingly, the trains are controlled so as to get back the delayed time by shorten the stoppage time of a retarded train, if the headways between the retarded train and each train of the preceding train and the following train are within a specified range at the point of time when it is estimated that the stoppage time of the retarded train at a certain station will be shorter than the scheduled time. Furthermore, the rail time of the retarded train is controlled so as to be shorten as much as possible, if the headways between the retarded train and each train of the preceding train and the following train are within a specified range similarly. As described above, the train group can be controlled more smoothly by setting the adjustment amounts of the stoppage time and rail time.

Similarly to the embodiment 1, it is possible to previously set the optimum values of the control parameters by simulations, if the traffic flow feature modes can be distinguished. Also, the control parameters can be corrected in accordance with control results.

It will be appreciated from the foregoing description that, according to the first aspect of the present invention, the traffic means controlling apparatus is constructed to construct and modify the distinction function of its feature distinguishing part by the use of its distinction function constructing part, and to distinguish the feature modes of traffic flows in prescribed time zones from the traffic volume data detected by its traffic volume detecting part by the use of its feature distinguishing part, and further to make its control parameter setting part set the optimum control parameters in accordance with the distinction results, and consequently, the traffic means controlling apparatus has effects that the efficient control of traffic means without using specified feature elements is enabled and that the service performance of traffic means is remarkably improved.

Furthermore, according to the second aspect of the present invention, the traffic means controlling apparatus is constructed to be further provided with a control result detecting part executing the detection of control results and drive results, and to make its parameter setting part set and correct the optimum control parameters on the basis of the distinction results distinguished by its feature distinguishing part and the control results and drive results detected by its control result detecting part, and further the traffic means controlling apparatus is constructed to be provided with a user interface for the setting and the correction of the control parameters by a user from the outside with the aforementioned control results and the drive results referred, and consequently, the traffic means controlling apparatus has effects that traffic means can efficiently be controlled without using specified feature elements, and that the setting and the correction of the control parameters being efficient for the user become capable, and further that the service performance of traffic means is remarkably improved.

Furthermore, according to the third aspect of the present invention, the traffic means controlling apparatus is constructed to be further provided with a traffic volume estimating part estimating the traffic volumes in the near future from the point of time when its traffic volume detecting part detected traffic volumes by executing the sampling processing of the traffic volumes detected by the traffic volume detecting part in real time, and consequently, the traffic means controlling apparatus has an effect that the feature modes of traffic flows can be distinguished on the basis of the precisely estimated traffic volumes.

Furthermore, according to the fourth aspect of the present invention, the traffic means controlling apparatus is constructed to executes the distinction of feature modes from the detected traffic volume data by the use of a NN, and consequently, the traffic means controlling apparatus has an effect that the feature modes can be distinguished with higher precision.

Furthermore, according to the fifth aspect of the present invention, the traffic means controlling apparatus is constructed to execute the detection of feature modes by means of filtering the output values of a NN, and consequently, the traffic means controlling apparatus has an effect that the feature mode having the highest similarity is easily detected from plural outputs of the NN.

Furthermore, according to the sixth aspect of the present invention, the traffic means controlling apparatus is constructed to enable the specification of feature modes by correcting its filtering function in case of being incapable of detecting feature modes, and consequently, the traffic means controlling apparatus has an effect that the distinction ability of feature modes can be improved.

Furthermore, according to the seventh aspect of the present invention, the traffic means controlling apparatus is constructed to enable the specification of feature mode by correcting its feature mode detection function in case of being incapable of detecting feature modes, and consequently, the traffic means controlling apparatus has an effect that the distinction ability of feature modes can be improved.

Furthermore, according to the eighth aspect of the present invention, the traffic means controlling apparatus is constructed to be provided with a NN for control and a NN for backup, and to correct its distinction function for control by replaces the distinction function for control with its distinction function for backup or duplicates the latter to the former when the distinction results in case of using the NN for backup are determined to be superior to the distinction results in case of using the NN for control as the result of comparing and evaluating the respective distinction result, and consequently, the traffic means controlling apparatus has an effect that the distinction precision of the distinction function can always be kept in good.

Furthermore, according to the ninth aspect of the invention, the traffic means controlling apparatus is constructed to construct and modify the distinction function of its NN by means of learning the previously prepared plural feature modes or the distinction results of past feature modes, and consequently, the traffic means controlling apparatus has an effect that the distinction precision of the distinction function can always be kept in good.

Furthermore, according to the tenth aspect of the present invention, the traffic means controlling apparatus is constructed to set the standard values of control parameters in accordance with feature mode distinction results, and to correct the standard values of the control parameters in accordance with the control results and the drive results by means of offline tuning, and consequently, the traffic means controlling apparatus has an effect that the control of traffic means by the use of the optimum control parameters can be done.

Furthermore, according to the eleventh aspect of the present invention, the traffic means controlling apparatus is constructed to set the standard values of control parameters in accordance with feature mode distinction results, and to correct the control parameter values from the standard values by means of online tuning in accordance with the control results and the drive results monitored in real time, and consequently, the traffic means controlling apparatus has an effect that the control of traffic means by the use of the optimum control parameters can be done.

Furthermore, according to the twelfth aspect of the present invention, the traffic means controlling apparatus is constructed to be provided with a user interface for exhibiting the control results, the drive results and the like, and for the setting and the correction of the control parameters by a user with those data referred, and consequently, the traffic means controlling apparatus has an effect that the user can effectively set and correct the control parameters.

While preferred embodiments of the present invention have been described using specific terms, such description is for illustrative purposes only, and it is to be understood that changes and variations may be made without departing from the spirit or scope of the following claims.

What is claimed is:

1. A traffic means controlling apparatus comprising:

a traffic volume detecting part that detects a traffic volume of a traffic means;

a feature distinguishing part that selects a feature mode, representing a mode of operation of the traffic means controlling apparatus, from a plurality of feature modes based upon the traffic volume detected by said traffic volume detecting part according to a distinction function;

a distinction function constructing part that constructs the distinction function of said feature distinguishing part based upon the plurality of feature modes and a plurality of feature mode traffic volumes respectively corresponding to each of the plurality of feature modes; and a control parameter setting part that sets a control parameter for controlling the traffic means based on the feature mode selected by said feature mode distinguishing part.

2. The traffic means controlling apparatus according to claim 1 wherein said feature distinguishing part includes a feature mode distinguishing means that includes a neural network, the neural network receiving the traffic volume and an outputting an indication of the similarity of the traffic volume to the feature mode traffic volume of each of the plurality of feature modes.

3. The traffic means controlling apparatus according to claim 2 wherein said feature mode distinguishing means in said feature distinguishing part includes;

a first neural network for control for executing the distinction of said feature mode to create a first distinction result; and a second neural network for backup for periodically executing the distinction of said feature mode to create a second distinction result;

and wherein said distinction function constructing part compares and evaluates distinction results of the first neural network and the second neural network to replace the contents of said first neural network for control with the contents of said second neural network for backup when said distinction result is superior to the first distinction result.

4. The traffic means controlling apparatus according to claim 2 wherein said feature distinguishing part further includes a feature mode detecting means that includes:

a filter for filtering the indication output by of said neural network of said feature mode distinguishing means and for providing a binary output corresponding to each of the plurality of feature modes, the binary output being indicative of whether the corresponding feature mode is the selected feature mode: and a feature mode specifying means for selecting a feature mode from the output of said filter.

5. The traffic means controlling apparatus according to claim 4 wherein said feature mode detecting means further comprises an additional filtering means that adjusts said filter when said filter has more than one binary output indicative of a selected filter mode, and when said filter does not have an output indicative of the selected filter mode.

6. The traffic means controlling apparatus according to claim 5 wherein the filter includes a threshold value for creating the binary output, and wherein the additional filter means adjusts the filter by adjusting the threshold value.

7. The traffic means controlling apparatus according to claim 4 wherein said feature mode detecting means further comprises an additional feature mode specifying means that adds a new feature mode to the plurality of feature modes when said filter does not have an output indicative of a selected filter mode.

8. The traffic means controlling apparatus according to claim 2 wherein said distinction function constructing part further constructs the distinction function of said neural network by learning a distinction result of the distinction function that selected a previous feature mode in response to a previous traffic volume.

9. The traffic means controlling apparatus of claim 1, further comprising:

a control result detecting part that detects a control result of controlling said traffic means resulting from the feature mode selected by the feature distinguishing part; and a user interface for receiving a user input to correct said control parameter;

wherein the control parameter setting part further comprises means for correcting said control parameter in accordance with the control result.

10. The traffic means controlling apparatus of claim 1, further comprising:

a traffic volume estimating part that estimates in real time a future traffic volume by executing the sampling processing of the traffic volume detected by said traffic volume detecting means in real time;

a control result detecting part that detects a control result of controlling said traffic means resulting from the feature mode selected by the feature distinguishing part; and a user interface for receiving a user input to correct said control parameter;

wherein the control parameter setting part further comprises means for correcting said control parameter in accordance with the control result; and wherein the feature distinguishing part includes means for selecting the feature mode based upon the future volume estimated by said traffic volume estimating part.

11. A traffic means controlling apparatus comprising:

a traffic volume detecting part that detects a traffic volume of a traffic means;

a feature distinguishing part that selects a feature mode, representing a mode of operation of the traffic means controlling apparatus from a plurality of feature modes based upon the traffic volume detected by said traffic volume detecting part according to a distinction function;

a distinction function constructing part that constructs the distinction function of said future distinguishing part based upon the plurality of feature modes and a plurality of feature mode traffic volumes respectively corresponding to each of the plurality of feature modes;

a control result detecting part that detects a control result of controlling said traffic means resulting from the feature mode selected by the feature distinguishing part;

a control parameter setting part that sets a control parameter for controlling the traffic means based on the feature mode selected by said feature mode distinguishing part and corrects said control parameter in accordance with the control result; and a user interface for receiving a user input to correct said control parameter.

12. The traffic means controlling apparatus according to claim 11 wherein said control parameter setting part sets a standard value of the control parameter in accordance with said feature mode selected by said feature distinguishing part, and corrects said standard value of the control parameter by means of offline tuning in accordance with the control result detected by said control result detecting part.

13. The traffic means controlling apparatus according to claim 11 wherein said control parameter setting part sets a standard value of the control parameter in accordance with said feature mode selected by said feature distinguishing part, and corrects said standard value of the control parameter by means of online tuning in accordance with the result detected by said control result detecting part in real time.

14. The traffic means controlling apparatus according to claim 11 wherein the control result detected by the control result detecting part includes a drive result representing a response of the traffic means responsive to the selected feature mode.

15. The traffic means controlling apparatus according to claim 11 wherein said result data exhibited by said user interface includes at least one of a control result and a drive result detected by the control result detecting part.

16. The traffic means controlling apparatus according to claim 11 wherein said user interface has a function of exhibiting result data to a user, and a function of receiving a direction from a user referring said data for correcting said control parameter.

17. A traffic means controlling apparatus comprising:

a traffic volume detecting part that detects a traffic volume of a traffic means;

a traffic volume estimating part that estimates in real time a future traffic volume by executing the sampling processing of the traffic volume detected by said traffic volume detecting means in real time;

a feature distinguishing part that selects a feature mode, representing a mode or operation of the traffic means controlling apparatus, from a plurality of feature modes based upon the traffic volume estimated by said traffic volume estimating part according to a distinction function;

a distinction function constructing part that constructs the distinction function of said feature distinguishing part based upon the plurality of feature modes and a plurality of feature mode traffic volumes respectively corresponding to each of the plurality of feature modes:

a control result detecting part that detects a control result of controlling said traffic means resulting from the feature mode selected by the feature distinguishing part;

a control parameter setting part that sets a control parameter for controlling the traffic means based on the feature mode selected by said feature mode distinguishing part and corrects said control parameter in accordance with the control result detected by said control result detecting part; and a user interface for receiving a user input to correct said control parameter.

18. The traffic means controlling apparatus according to claim 17 wherein the control result detected by the control result detecting part includes a drive result representing a response of the traffic means responsive to the selected feature mode.

* * * * *